US009259738B2

(12) United States Patent
Orphall

(10) Patent No.: US 9,259,738 B2
(45) Date of Patent: Feb. 16, 2016

(54) HAMMER ASSEMBLY FOR A ROTARY MATERIAL CRUSHER

(75) Inventor: Gregory Kurt Orphall, Venetia, PA (US)

(73) Assignee: RQI, INC., Venetia, PA (US)

( * ) Notice: Subject to any disclaimer, the term of this patent is extended or adjusted under 35 U.S.C. 154(b) by 1086 days.

(21) Appl. No.: 13/101,571

(22) Filed: May 5, 2011

(65) Prior Publication Data

US 2011/0204172 A1 Aug. 25, 2011

Related U.S. Application Data

(63) Continuation-in-part of application No. 12/504,987, filed on Jul. 17, 2009, now Pat. No. 7,975,949.

(60) Provisional application No. 61/137,034, filed on Jul. 25, 2008.

(51) Int. Cl.
*B02C 13/28* (2006.01)

(52) U.S. Cl.
CPC ..... *B02C 13/2804* (2013.01); *B02C 13/28* (2013.01)

(58) Field of Classification Search
CPC ..... B02C 13/00; B02C 13/04; B02C 13/06; B02C 13/02; B02C 13/28; B02C 13/2804
USPC ..... 241/189.1, 294, 195; 144/241, 227, 144/230, 229, 236, 240
See application file for complete search history.

(56) References Cited

U.S. PATENT DOCUMENTS

| | | | | |
|---|---|---|---|---|
| 3,510,076 | A * | 5/1970 | Perdue | 241/197 |
| 4,046,327 | A * | 9/1977 | Cranor | 241/197 |
| 4,679,740 | A * | 7/1987 | Orphall | 241/189.1 |
| 6,481,654 | B1 * | 11/2002 | Balvanz et al. | 241/191 |
| 7,959,098 | B2 * | 6/2011 | Doppstadt et al. | 241/197 |

* cited by examiner

*Primary Examiner* — Shelley Self
*Assistant Examiner* — Matthew G Katcoff
(74) *Attorney, Agent, or Firm* — Kratz, Quintos & Hanson, LLP

(57) ABSTRACT

A hammer assembly for attachment to a rotor of a rotary material crusher. The hammer assembly has an adaptor for attaching to the rotor, having a base portion and a hammer mounting portion, with the base portion being attachable to the rotor at the periphery portion thereof, and a hammer for mounting on the adaptor, having at least one impact portion, for crushing material, and a mounting portion for engagement with the hammer mounting portion of the adaptor. The hammer mounting portion of the adaptor includes bearing surfaces facing a direction of impact when crushing material, and the mounting portion of the hammer includes bearing surfaces for mating with the bearing surfaces of the hammer mounting portion of the adaptor. The hammer assembly further includes a retainer rod for preventing demounting of the hammer from the adaptor. The retainer rod passes through an opening formed by a retainer rod groove in the hammer and a retainer rod groove in the adaptor which face each other. The size of the retainer rod and the size of the grooves are selected such that the hammer is free to move to enable the bearing surfaces of the hammer to bear on the bearing surfaces of the adaptor and transfer impact forces when impact forces from crushing material are present, with the retainer rod being free from any of the impact forces.

2 Claims, 32 Drawing Sheets

HAMMER ASSEMBLY FOR A ROTARY MATERIAL CRUSHER

The present application is a continuation-in-part of U.S. patent application Ser. No. 12/504,987, filed Jul. 17, 2009, which claims priority of U.S. Provisional Application Ser. No. 61/137,034 filed Jul. 25, 2008.

FIELD OF THE INVENTION

This invention is concerned with a hammer assembly for attachment to a rotor of a rotary material crusher. In particular this invention is concerned with a hammer assembly which reduces the time and the difficulty normally associated with replacing worn hammers of a rotary material crusher.

BACKGROUND OF THE INVENTION

In rotary material crushers, a rotor having hammers attached to a peripheral portion of the rotor are driven to rotate at speeds from 300 to 800 rpm, which translates to linear speeds for the hammers from 5000 to 8000 feet per minute, so as to have the hammers impact material such as limestone, and the like, in order to reduce the size of the material. Such crushing of material generates high impact forces on the hammers, which are in turn transferred to the rotor. In view of the high impact forces, it is important to provide a robust means for attaching the hammers to the rotor, but at the same time providing an attaching means which enables the hammers to be easily removed and replaced when excessive wear to the hammers causes them to be unusable.

Conventional means for attaching the hammers to the rotor, such as bolts, or the like, have been found to be undesirable, as the above-described impact forces, besides acting on solely the hammers, also act on the attaching means in a manner that makes removal by conventional means difficult and time consuming.

OBJECTS OF THE INVENTION

A consideration in providing a means of attaching the hammers to the rotors, is to provide a means which enables replacement of the hammers without requiring removal of the rotor from the rotary crushing machine, and without requiring a large opening in side plates, or the like, of the machine, that are positioned adjacent ends of the rotor.

Another consideration in providing a means of attaching the hammers to the rotor, is to provide proper means for transferring the tremendous impact forces from the hammers to the rotor by positioning any bearing surfaces of the attachment means at the proper orientation in relation to the direction of the impact forces.

The present invention takes into account the above-discussed considerations and provides a means for attaching a hammer to a rotor, which reduces the time and difficulty for replacing the hammers found in prior attachment means and at the same time provides a robust attachment that is able to withstand the tremendous impact forces found in a rotary crushing machine.

DESCRIPTION OF THE DRAWINGS

The present invention will be more clearly understood from the following description of embodiments of the invention, which are disclosed with use of the appended drawings. In the drawings.

DETAILED DESCRIPTION

Figure 1:
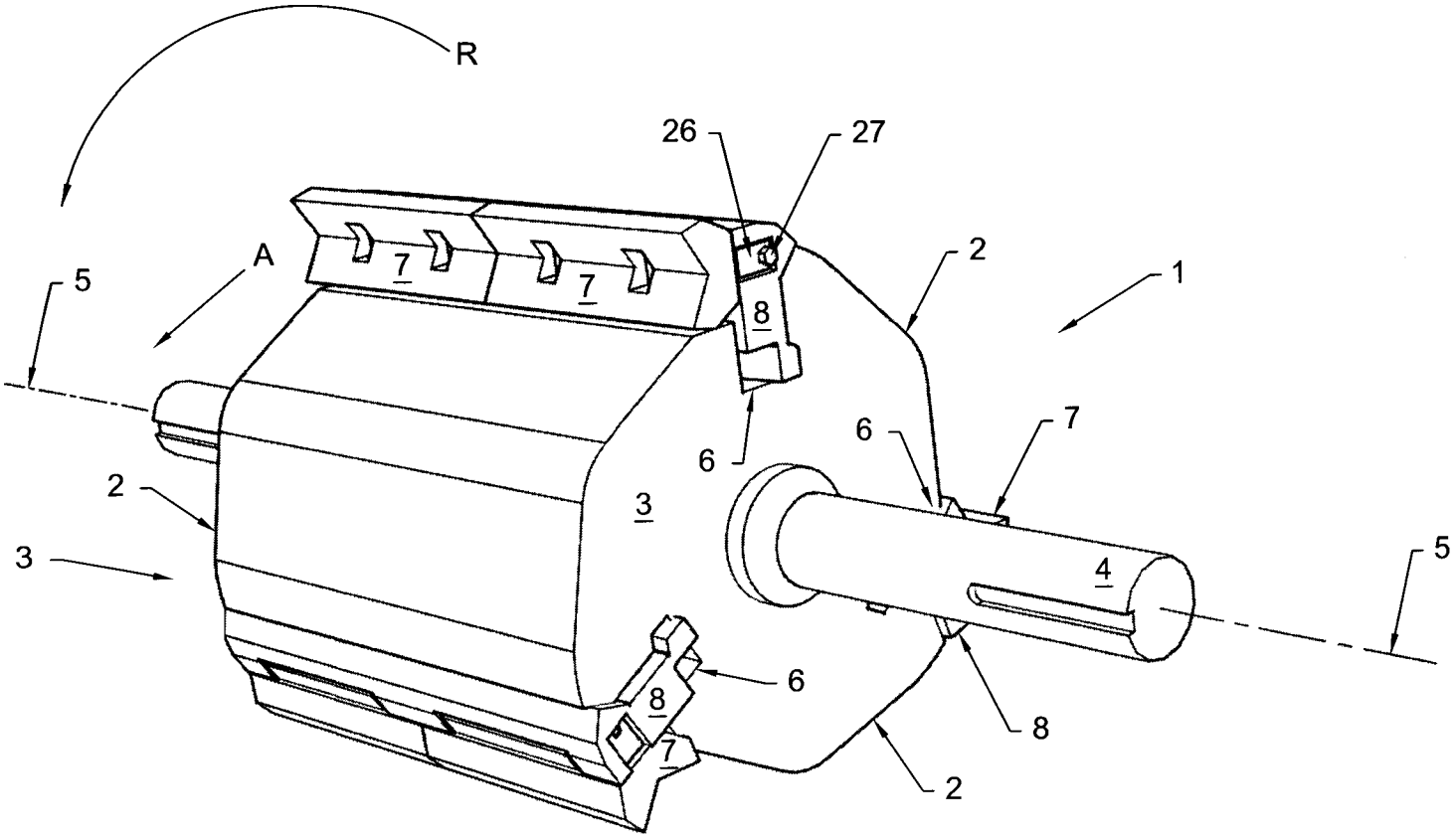
FIG. 1 is a perspective view of a first embodiment of the invention mounted to a rotor of a rotary material crusher.

A first, second and third embodiment of the invention are described below. FIG. 1 shows a rotor 1 of a rotary material crusher. The rotor has a generally cylindrical shape with a peripheral portion, indicated at 2, and opposing ends 3. A shaft 4 penetrates through the rotor body and extends from each end of the rotor into bearings of the rotary material crusher. A means for rotating the rotor is provided on at least one end of the shaft for connection to a means for driving the rotor. An axis of rotation 5 is shown extending through the shafts and rotor. The rotor 1 shown in FIG. 1 is the same for use with the first and second embodiments of the invention, and similar portions of the rotors shown in the discloser of both the embodiments are marked with the same numeric indicators. Arrow R shoes the direction of rotation.

Disposed at the peripheral portion of the rotor are at least two attachment grooves 6 for use in attaching at least two hammers 7 to the rotor. In the embodiment of FIG. 1, three pairs of hammers are attached to the rotor. In the following disclosure only one hammer of a hammer assembly will be described, however it is to be understood that any number of attachment grooves 6 can be disposed circumferentially around the rotor, and any number of hammers 7 can be attached along the attachment groove 6. To have attachment grooves disposed in the peripheral portion of a rotor is known in the art.

In use of the rotary material crusher, in view of the tremendous impact from the material and the abrasive nature of the material being crushed by the hammers 7, it is necessary to periodically replace the hammers because of extensive wear at the impact surface, which eventually renders the hammer unusable. In certain embodiments it is possible to merely reverse the orientation of the hammers, in relation to the direction of rotation of the rotor, to expose a fresh impact surface, if the hammers are provided with a second impact surface. The present invention can accommodate a hammer having a second impact surface and the hammer shown in the drawings of the first and second embodiments, has a second impact surface.

Figure 2:
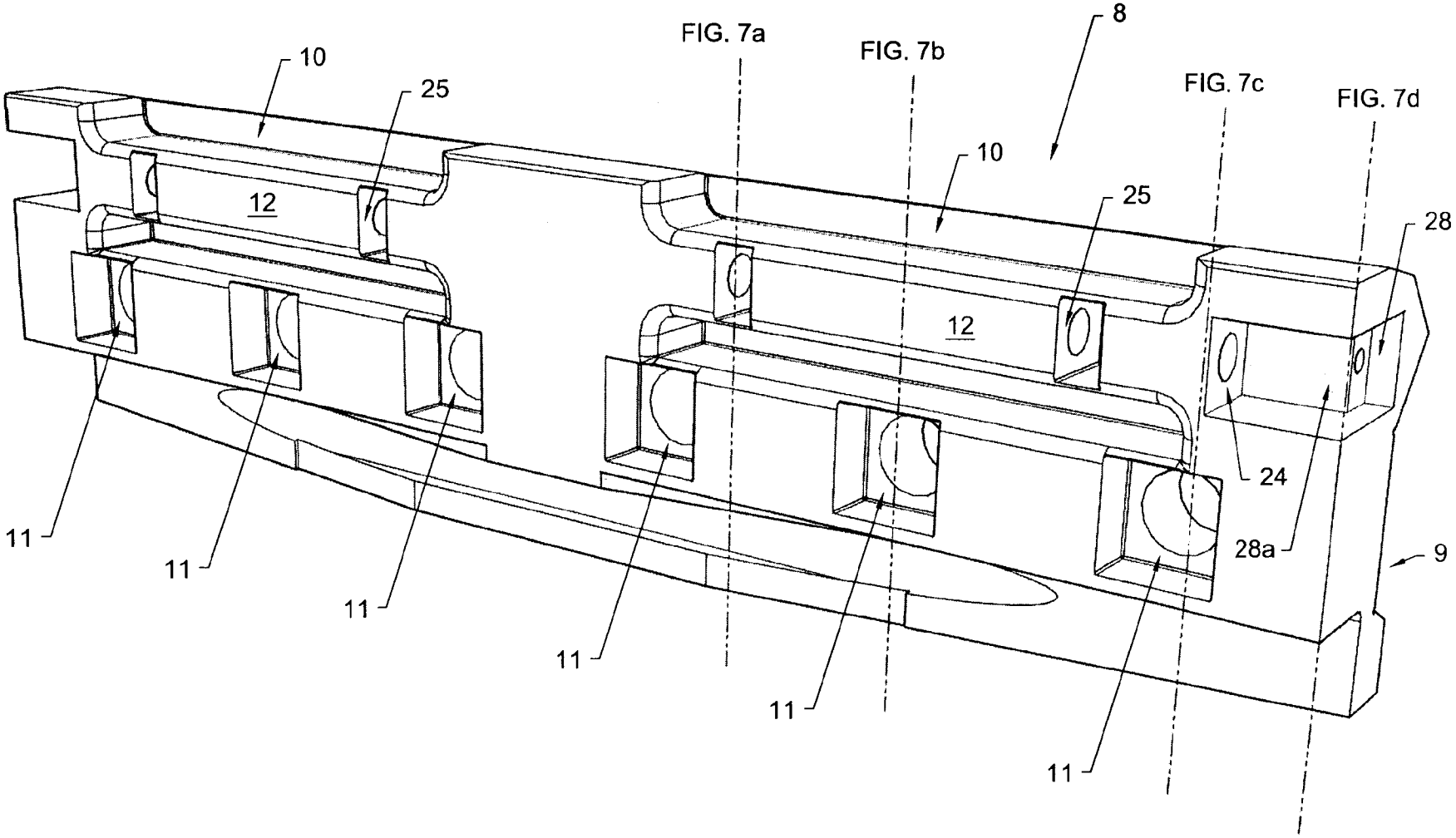
FIG. 2 is a perspective view of an adaptor of the first embodiment of the invention for engaging a hammer of the invention to attach the hammer to the rotor.

In the present invention an adaptor 8, shown attached to the rotor in FIG. 1 and shown in perspective and unattached in FIG. 2, is attached to the rotor in attachment groove 6. The adaptor 8 is made up of a base portion 9 and a hammer mounting portion 10, as indicated in FIG. 2. The base portion 9 seats in attachment groove 6, as shown in FIG. 1, and can be secured to the rotor by any known means. As shown in FIG. 2, bolt holes, such as those shown at 11, can be used for securing the adaptor to the rotor along with wedging blocks, or the like. The means for attaching the adaptor to the rotor is not a feature of the present invention. The feature of the present invention can be used along with any means of attaching the base portion 9 of the adaptor to the rotor. In the first and second embodiments of the invention, the base portion 9 of the adaptor is similar.

In use of the present invention, the adaptor preferably remains on the rotor during periodic replacement of the hammer, thus reducing the time and labor required for replacing the hammer.

When the adaptor is attached to the rotor, the hammer mounting portion 10 of the adaptor preferably extends outward in a substantially radial direction in relation to the axis of rotation 5. The adaptor shown in FIGS. 1 and 2 is configured to accommodate two hammers, as shown in FIG. 1, however an adaptor of the invention can be configured to accommodate solely one hammer, or more than two hammers.

The hammer mounting portion 10 of the adaptor includes a ridge 12 extending in the direction of a longitudinal axis of the adaptor. The hammer is configured to mate with ridge 12.

Figure 3:
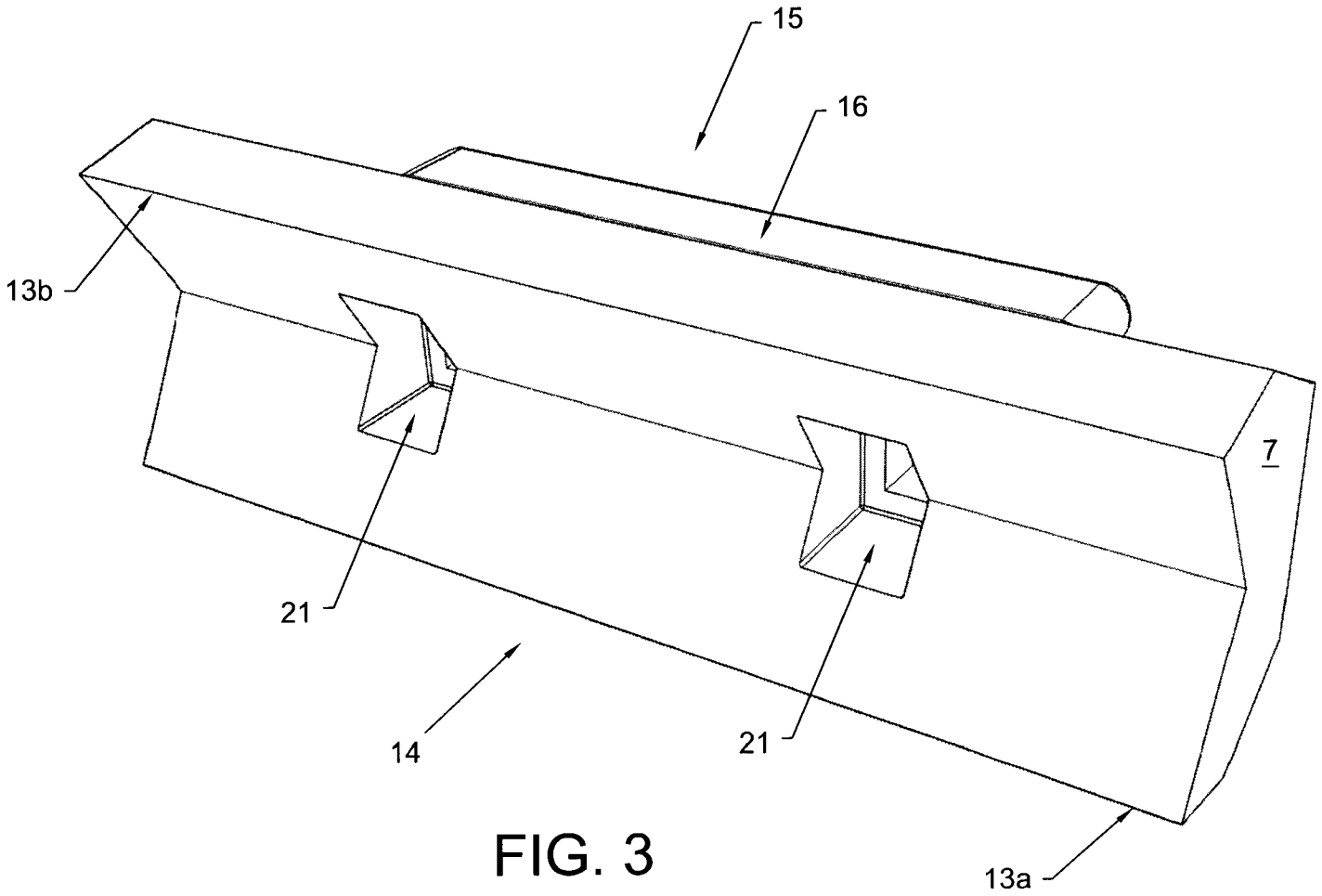
FIG. 3 is a perspective view of a hammer of the first embodiment of the invention.

FIG. 3 shows a hammer of the invention having impact surfaces 13*a* and 13*b*. The preferred embodiment of the invention features a hammer with two impact surfaces to enable reversing of the orientation of the hammer when one of the surfaces is worn.

Figure 6:
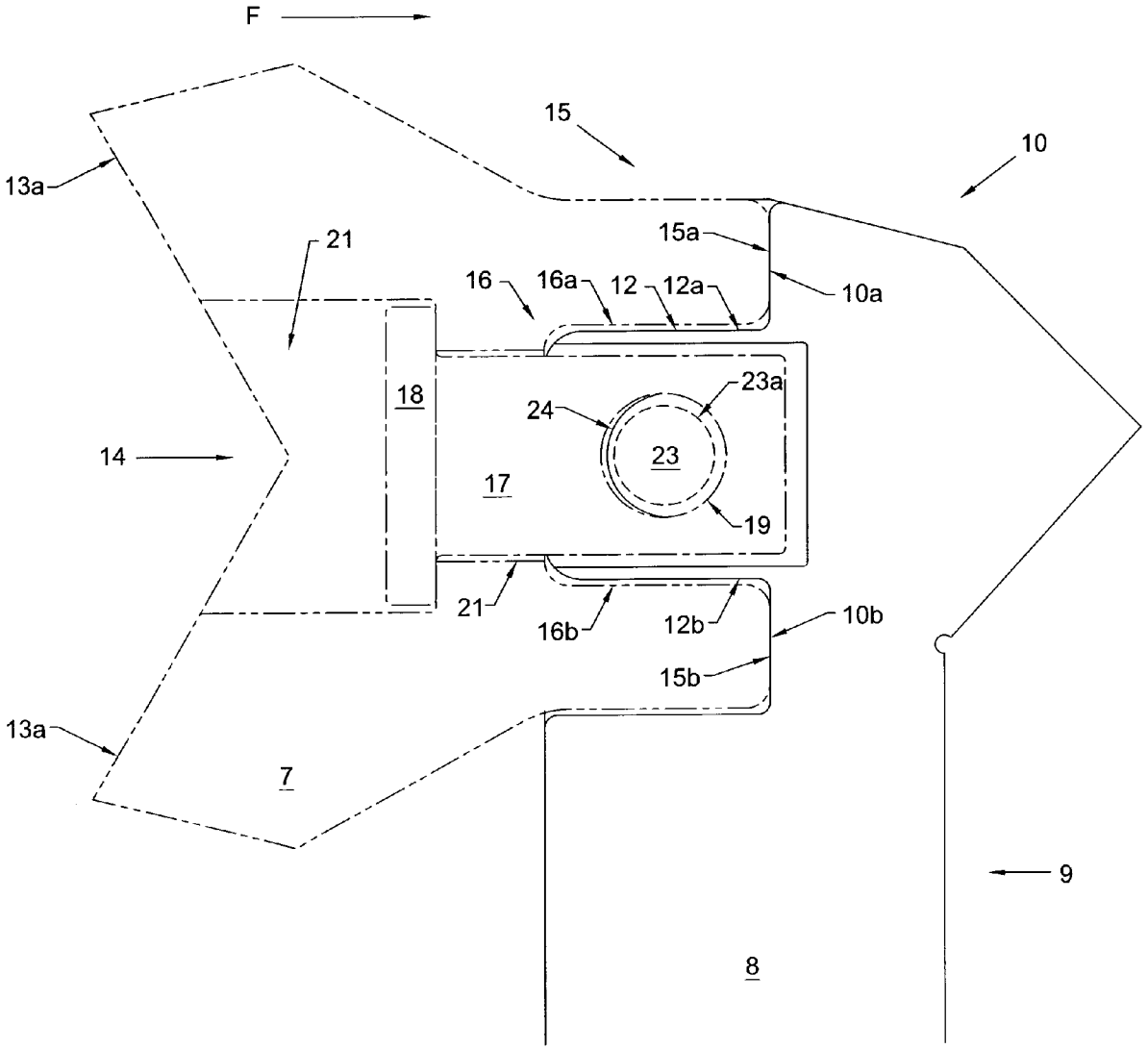
FIG. 6 is an end view of the hammer assembly of the first embodiment of the invention for showing relative sizes of apertures and the retainer rod.

The two impact surfaces are disposed at an impact portion 14 of the hammer. Opposed to the impact portion is a mounting portion 15 of the hammer, for engagement with the hammer mounting portion 10 of the adaptor. The mounting portion 15 of the hammer includes a grooved portion 16, partially shown in FIG. 3, but better shown in FIG. 6. FIG. 6, a cross-sectional view in a direction perpendicular to longitudinal axes of the hammer and the adaptor, shows hammer 7, adaptor 8 and retainer pin 17, which is described below. As shown in FIG. 6, when the hammer 7 is mounted to the adaptor 8, the grooved portion 16 of the hammer mates with the ridge 12 of the adaptor, to form a tongue and groove type arrangement. Surfaces of the ridge of the adaptor and surfaces of the groove of the hammer, which oppose each other when the hammer is mounted, are oriented such that surfaces 12*a* and 12*b* of the ridge of the adaptor and surfaces 16*a* and 16*b* of the grooved portion of the hammer face substantially in the direction of centrifugal forces resulting from the rotation of the rotor. Also, surfaces 10*a* and 10*b* of the hammer mounting portion of the adaptor, and surfaces 15*a* and 15*b* of the mounting portion of the hammer face substantially in the direction of impact forces resulting from the impact of the material being crushed by the impact surfaces 13*a* or 13*b* of the hammer. Additional surfaces, which are opposed to each other are described below.

The above-mentioned impact forces must be seriously considered as they are of a high magnitude, and any means for retaining the hammer on the adaptor must be able to remain in a condition that makes removal of the retainer means still possible after being subjected to the impact forces over a period of time.

Figure 4:
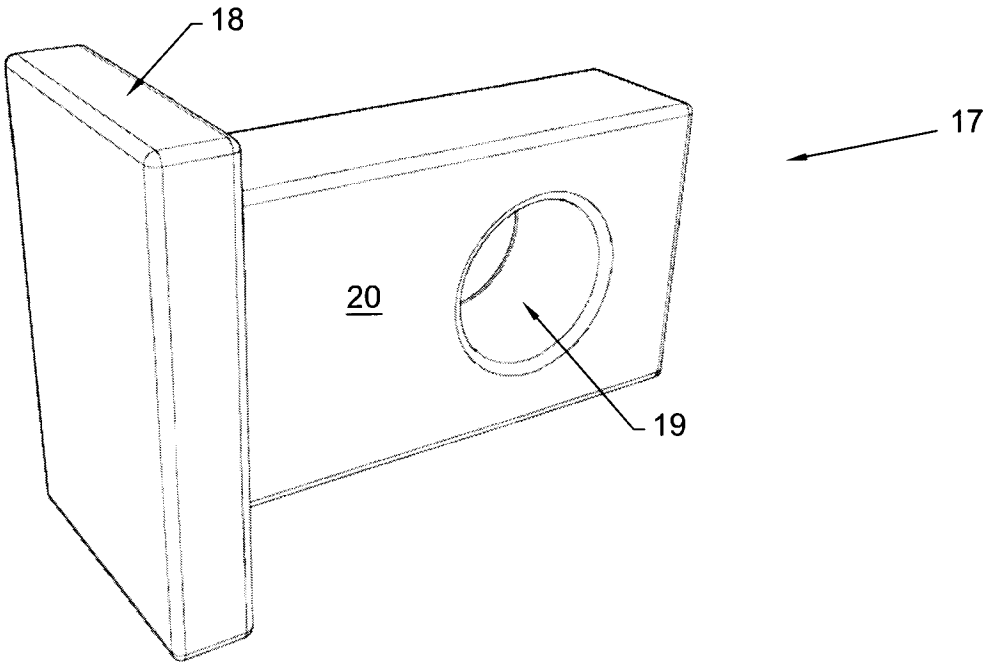
FIG. 4 is a perspective view of a retainer pin of the first embodiment of the invention.

FIG. 6 shows hammer 7 mounted on adaptor 8, along with a retainer pin 17. The retainer pin is shown in perspective in FIG. 4. Referring to FIG. 4, the retainer pin includes an end having head 18 and another end having an aperture 19. A body 20 of the retainer pin is dimensioned to pass through an opening 21 in the hammer, as best shown in FIG. 6. Preferably the body 17 and the head end 18 have a rectilinear shape. Also, preferably the head end 18 of the retainer pin fits into a recessed portion 11 of the hammer so as to be at least partially protected from impact with material being crushed.

Figure 5:
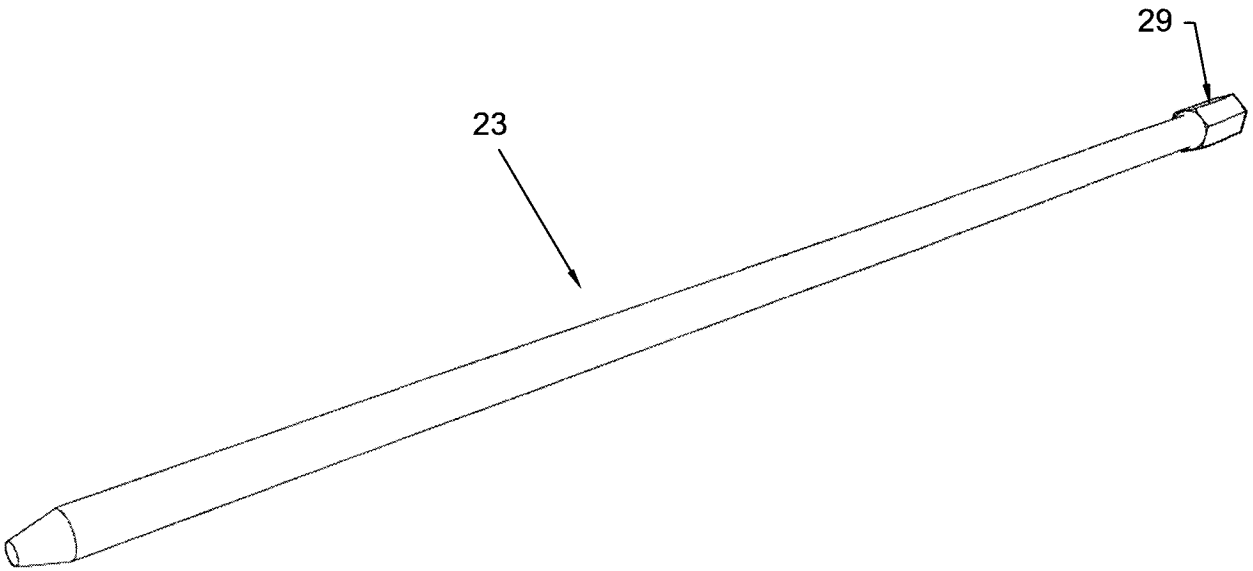
FIG. 5 is a perspective view of a retainer rod of the first, second and third embodiment of the invention.

To retain the hammer on the adaptor, with use of the retainer pin, a retainer rod 23, shown in FIG. 6, and also shown in perspective in FIG. 5 is used. The retainer rod passes through the aperture 19 in the retainer pin, as well as through an aperture 24 in the hammer mounting portion of the adaptor, which is disposed in a direction of a longitudinal axis of the adaptor, as shown in FIG. 2. The alignment of the retainer rod 23 through the aperture 19 of the retainer pin and the aperture 24 of the adaptor is shown in FIG. 6. In FIG. 6, the heavy dashed circle represents the aperture 19 of the retainer pin, the heavy solid circle represents the aperture 24 of the adaptor, and the light dashed circle 23*a* represents the retainer rod 23.

The relative sizes and locations of the retainer rod and the apertures of the adaptor and retainer pins is an important feature of the invention. The retainer rod is dimensioned to pass, freely through the apertures without need of a press or driver, or the like. A preferred difference in diameters of the retainer rod 23 and the aperture 19 of the retainer pin and the aperture 24 of the adaptor is about 10 mils.

The location of the apertures 19 and 24 in relation to various surfaces of the hammer and adaptor are considered, as follows, in order that none of the impact force is applied to any portion of the retainer rod 23 or apertures 19 and 24. Such consideration is important so that when removal of the hammer is necessary, the retainer rod and apertures are not deformed in any way that would prevent the retainer rod from being easily pulled out of the apertures. Referring to FIG. 6, when the hammer impacts the material being crushed, surfaces 15*a* and 15*b* of the hammer bear on surfaces 10*a* and 10*b* of the adaptor, to transfer the impact from the hammer to the adaptor, and in turn to the rotor. When the hammer is in the position shown in FIG. 6, relative to the adaptor, a clearance remains between the apertures 19 and 24, and the retainer rod 23, in the direction of impact force (F) so that no impact force is applied to the retainer rod. When the rotor is not in motion, the hammer may move in relation to the adaptor to separate surfaces 10*a* and 10*b* from 15*a* and 15*b*, and thus apply a force on the retainer rod 23 resulting from the weight of the hammer, however such force does not deform the retainer rod in any manner.

Figure 7A:
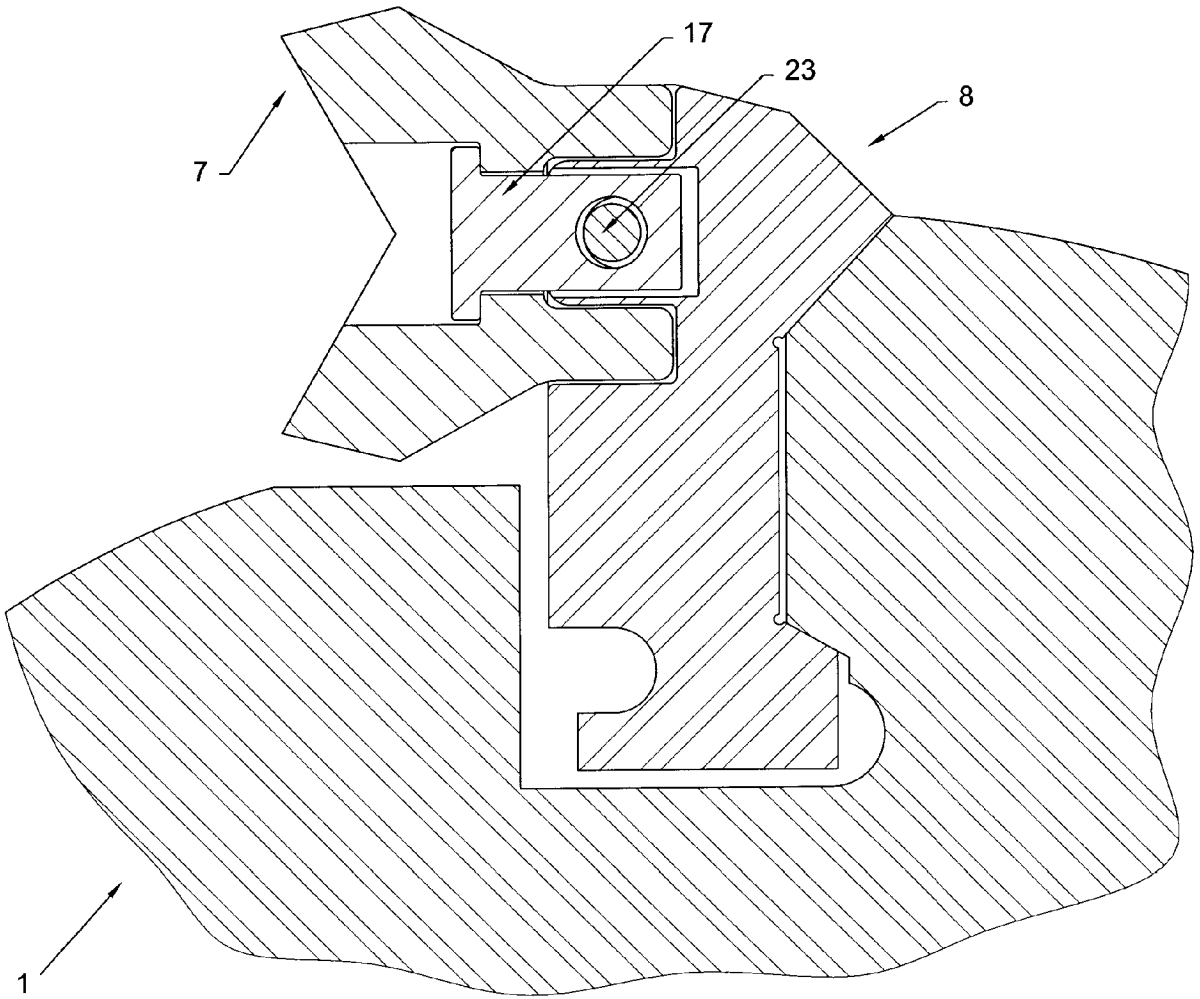
FIGS. 7*a* to 7*d* are cross-sectional views, in various planes perpendicular to the longitudinal axes of the hammer and the adaptor, for showing various features of the hammer assembly of the first embodiment of the invention.
Figure 7B:
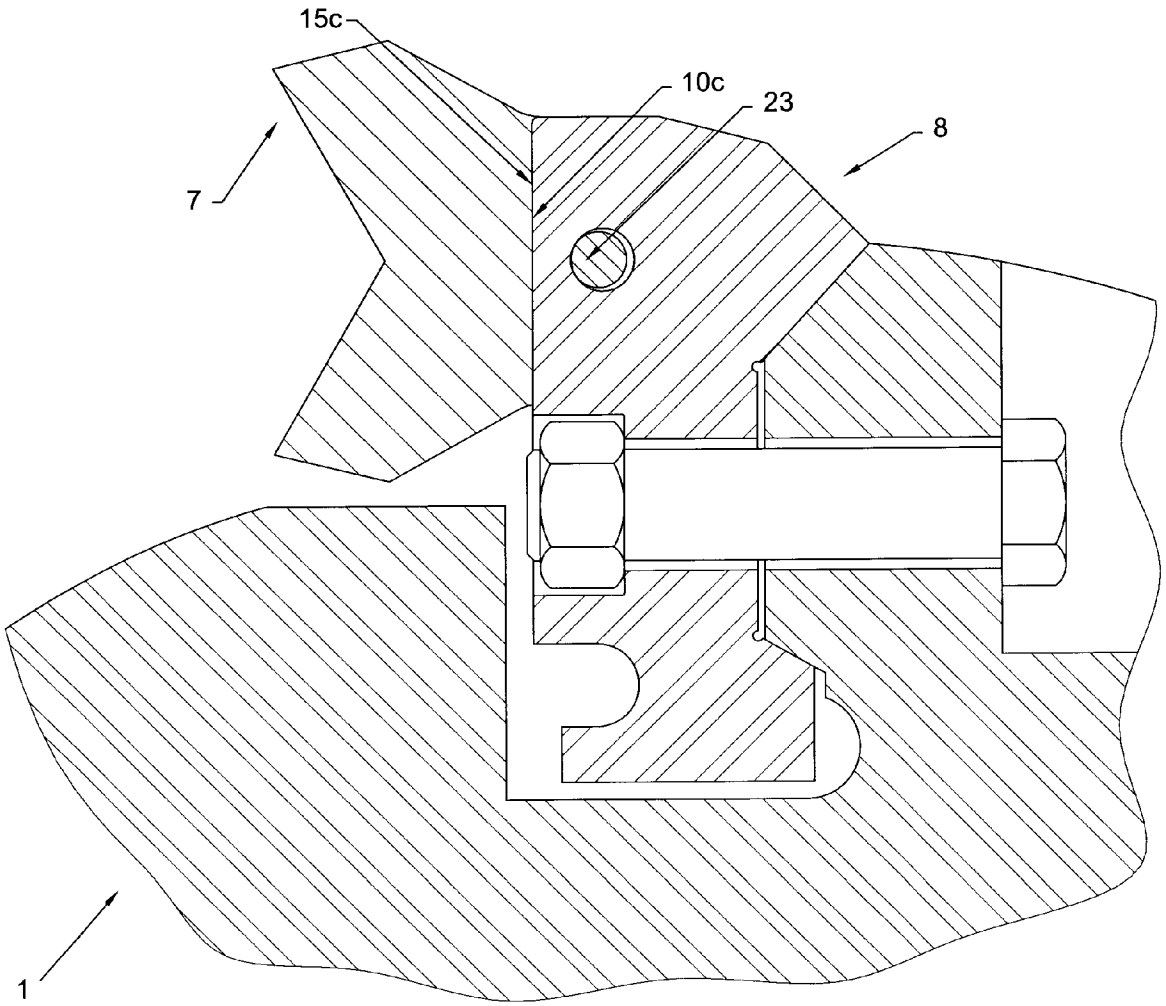
Figure 7C:
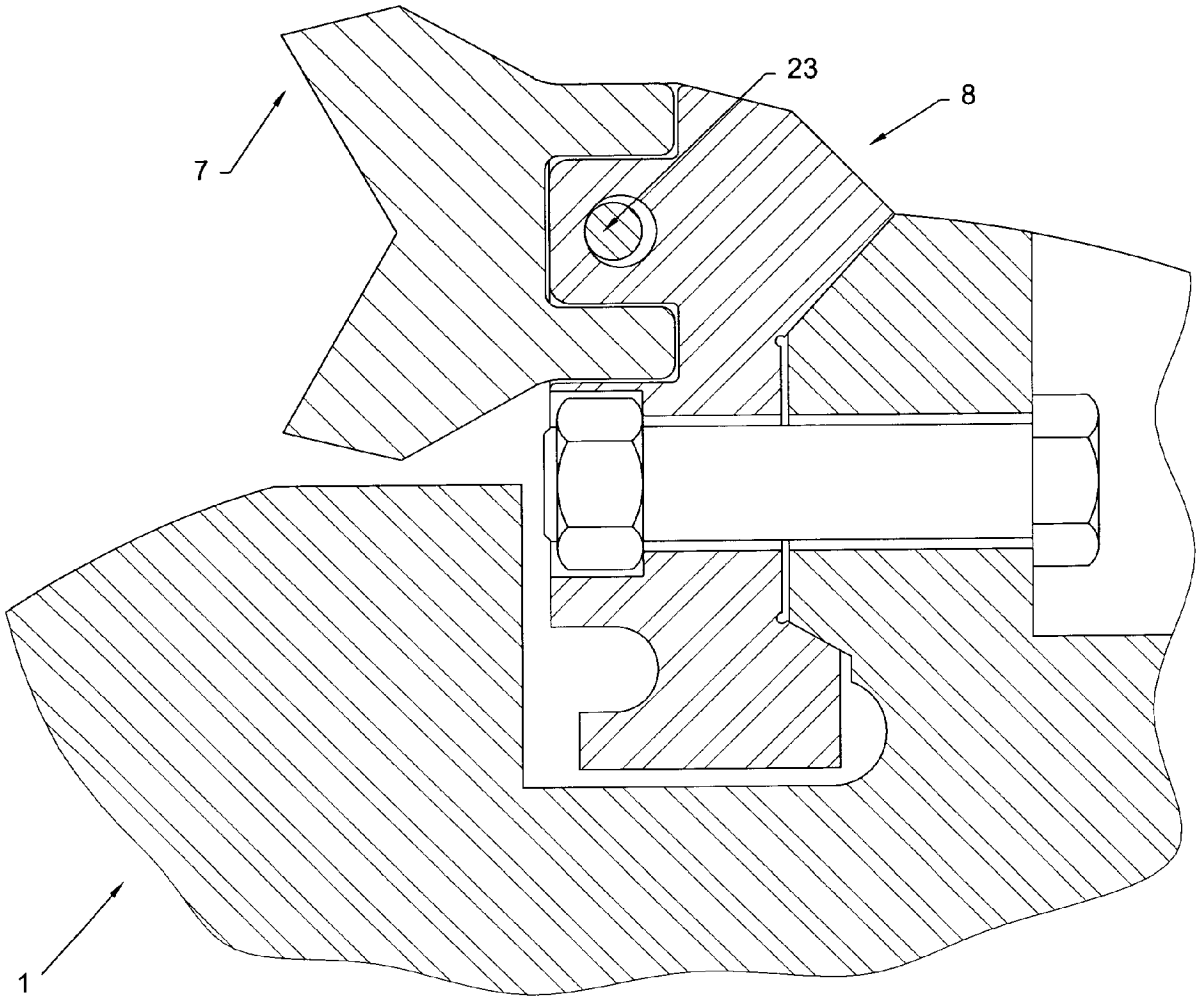
Figure 7D:
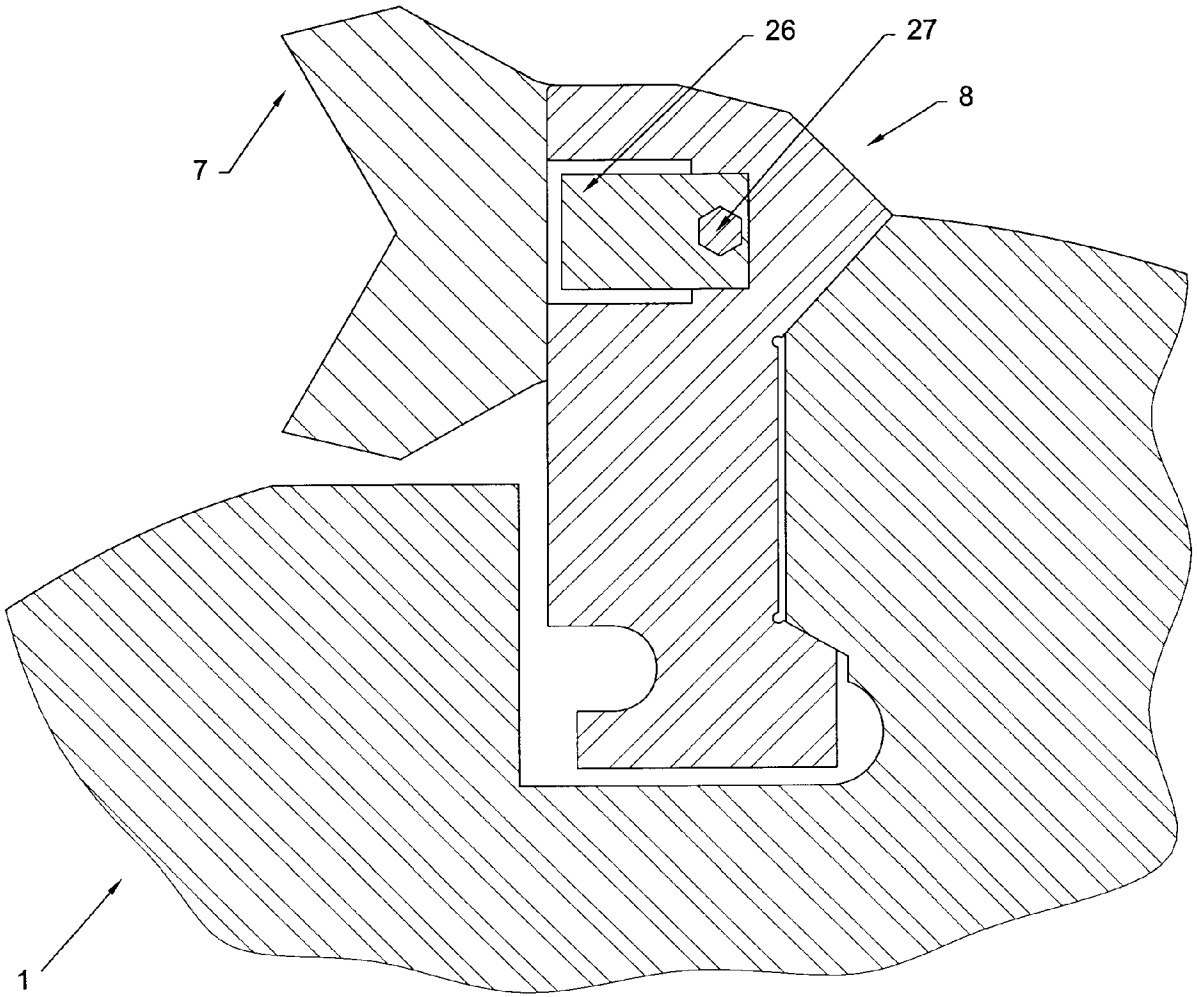

FIGS. 7*a*-7*d* show cross-sectional views of components of the hammer assembly at sections perpendicular to the longitudinal axes of the hammer, the adaptor, and the rotor. In FIG. 2 are dashed lines indicating the locations of the cross-sectional views shown in FIGS. 7*a*-7*d*. FIG. 7*a*, in general, corresponds to FIG. 6, however FIG. 7*a* includes a portion of the rotor 1. FIG. 7*a* is a cross-sectional view taken at a location of one of the retainer pins 17. FIG. 7*b* is a cross-sectional view taken at a location away from the retainer pin 17 and near an end of a hammer, for pointing out another surface of the adaptor 8 and hammer 7 which transfers the impact force from the hammer to the adaptor. Those surfaces are indicated at 10*c* and 15*c* and extend over a wider area than the surfaces described in relation to FIG. 6. The surface 10*c* is in the same plane as surfaces 10*a* and 10*b*. The surface 15*c* is in the same plane as surfaces 15*a* and 15*b*. FIG. 7*c* is a cross-sectional view taken between locations of the retainer pins. FIG. 7*d* is a cross-sectional view taken at an end of the hammer assembly and is discussed further, below.

As discussed above, retainer rod 23 is inserted through apertures 19 and 24 to retain the hammer on the adaptor. It is necessary to insert the retainer rod in a direction from one end of the rotor to the opposite end of the rotor, as shown in FIG. 1. However it is not necessary to remove the hammers by sliding them out in the same direction as necessary for the retainer rod, as after the retainer rod is removed, the hammer can be removed by pulling it outwardly in a direction indicated by arrow (A) in FIG. 1. As mentioned above, a rotary crushing machine most often has side plates near ends of the rotor and access to end portions of the rotor are difficult.

In the present invention, only a small access hole in one of the side plates of the machine is required for use in mounting the hammer and removing the hammer when replacement is necessary. Alternatively, the adaptor can be removed from the rotor prior to replacing a hammer, but such method requires more time and labor. To mount the hammer 7 to the adaptor 8 the grooved portion 16 of the hammer is placed over the ridge 12 of the adaptor. Next, each retainer pin is inserted through the opening 21 in the hammer and further through retainer openings 25, as shown in FIG. 6, which are located in the ridge 12 of the adaptor. Next, the retainer rod 23 is inserted to pass in turn, through aperture 24 of the adaptor, aperture 19 in the retainer pin, aperture 24 of the adaptor, aperture 19 in the retainer pin, and aperture 24 of the adaptor. The above sequence would be repeated again for a hammer assembly as shown in FIG. 6, having a single adaptor and two or more hammers.

In order to keep the retainer rod in place, a keeper plate 26 as shown in FIGS. 1 and 7*d* is bolted into place. It is important that the keeper plate and bolt 27 be below the plane of the end of the rotor, so as not to make contact with the side plates of the machine which are disposed near ends of the rotor. As shown in FIG. 2, a keeper plate recess 28 is formed at an end of the adaptor to accommodate the keeper plate and bolt head.

To replace a hammer it is necessary to retract the retainer rod in a direction opposite to that described above for inserting the rod. To facilitate the retracting, a threaded coupling 29, as shown in FIG. 5, is attached to the retainer rod prior to inserting the retainer rod when mounting the hammer to the adaptor. The threaded coupling can also be an integral part of the retainer rod. Preferably the threaded coupling has internal threads (female) into which an extraction tool (not shown), having external threads (male) of the same size and pitch can be threaded. After threading the extraction tool into the threaded coupling, force can be applied outwardly to remove the retainer rod from the hammer assembly.

With the attachment as described, the retainer rod can be rotated while applying the force to facilitate the extraction. By having internal threads on the threaded coupling and using a thread cap to protect the threads, there is less chance that the threads will become damaged during operation of the machine. As shown in FIG. 2, an additional recess 28*a* is formed in the end of the adaptor to accommodate the threaded coupling.

In a preferred embodiment, the adaptor has recesses 28 and 28*a* in both ends to enable insertion of the retainer rod in either direction, as different rotary material crusher machines can be accessed easier on one side than the other.

Figure 8:
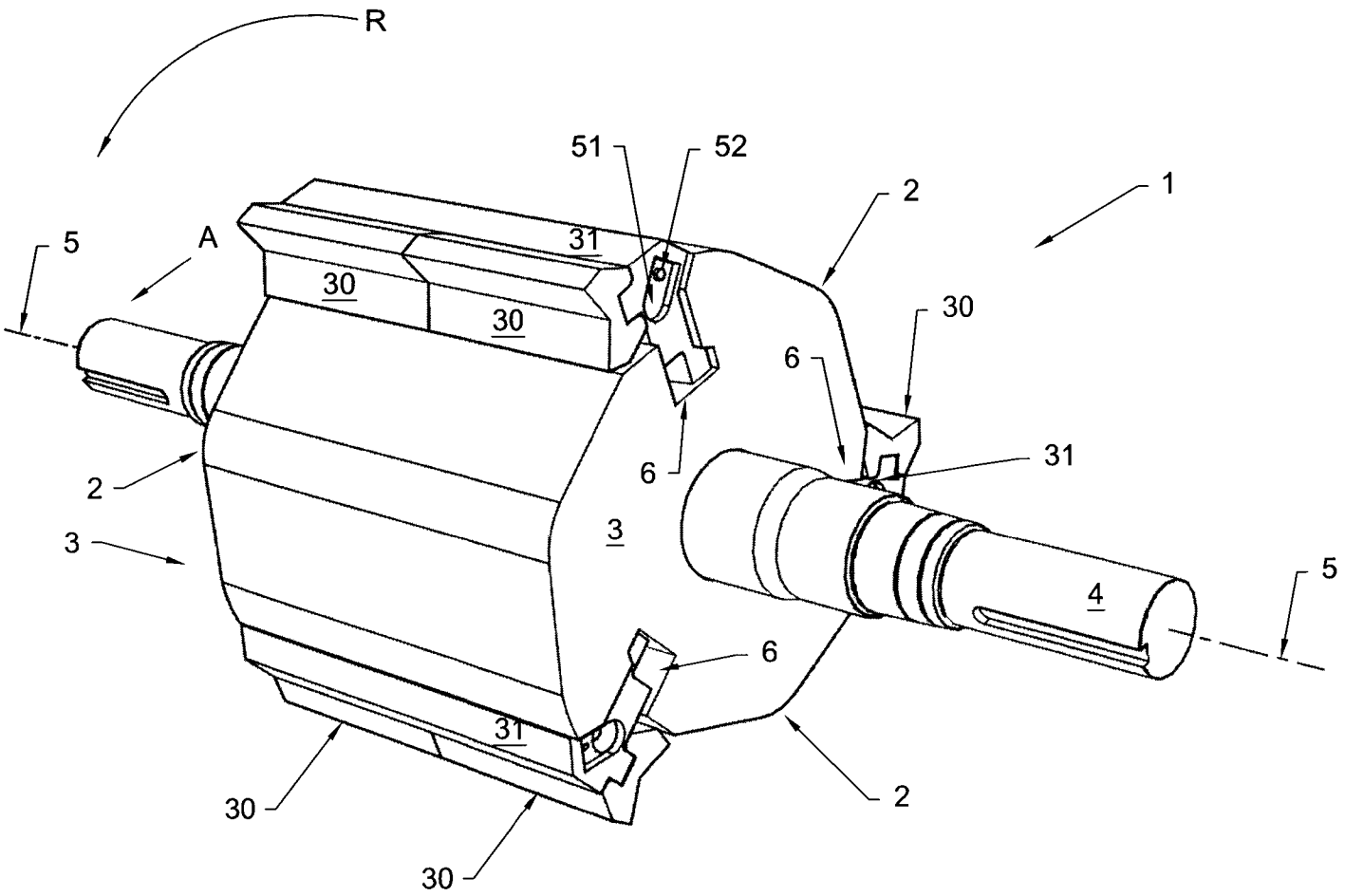
FIG. 8 is a perspective view of a second embodiment of the invention mounted to a rotor of a rotary material crusher.

A second embodiment of the invention is described with use of FIGS. 8 to 14. FIG. 8 shows a rotor 1 of a rotary material crusher. The rotor has the same features as described above in describing the first embodiment of the invention. Disposed at the peripheral portion of the rotor are at least two attachment grooves 6 for use in attaching at least two adaptors 31 and two hammers 30 to the rotor. In the embodiment of FIG. 8, three adaptors 31 and three pairs of hammers 30 are attached to the rotor. In the following disclosure only one hammer of a hammer assembly will be described, however it is to be understood that any number of attachment grooves 6 can be disposed circumferentially around the rotor, and any number of hammers 30 can be mounted on each adaptor.

The present embodiment of the invention can accommodate a hammer having a second impact surface and the hammer shown in the drawings has a second impact surface, which is further discussed below.

Figure 9:
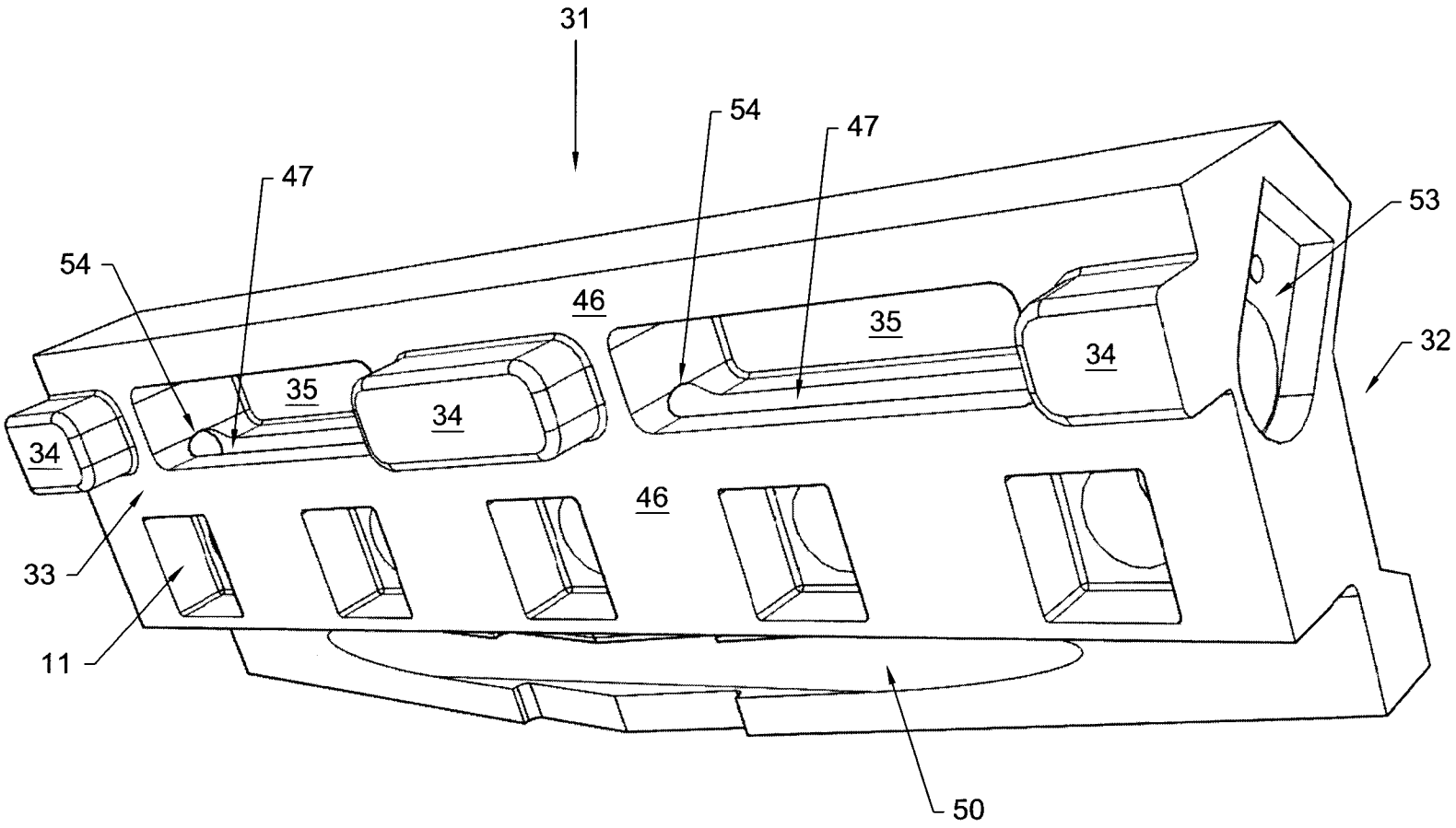
FIG. 9 is a perspective view of an adaptor of the second embodiment of the invention for use in attaching a hammer to the rotor.

In the present embodiment of the invention the adaptor 31, shown attached to the rotor in FIG. 8 and shown in perspective and unattached in FIG. 9, is attached to the rotor in attachment groove 6. The adaptor 31 is made up of a base portion 32 and a hammer mounting portion 33, as indicated in FIG. 9. The base portion 32 seats in attachment groove 6 of the rotor, as shown in FIG. 8, and can be secured to the rotor by any known means.

When the adaptor is attached to the rotor, the hammer mounting portion 33 of the adaptor preferably extends outward in a substantially radial direction in relation to the axis of rotation 5 of the rotor. The adaptor shown in FIGS. 8 and 9 is configured to accommodate two hammers, however an adaptor of the invention can be configured to accommodate solely one hammer, or more than two hammers.

The hammer mounting portion 33 of the adaptor includes ridges 34 extending in the direction of a longitudinal axis of the adaptor and cavities 35, also extending in the direction of the longitudinal axis of the adaptor, and in line with the ridges 34. The hammer 30 is configured to mate with ridges 34 and cavities 35 of the adaptor when mounted.

Figure 10:
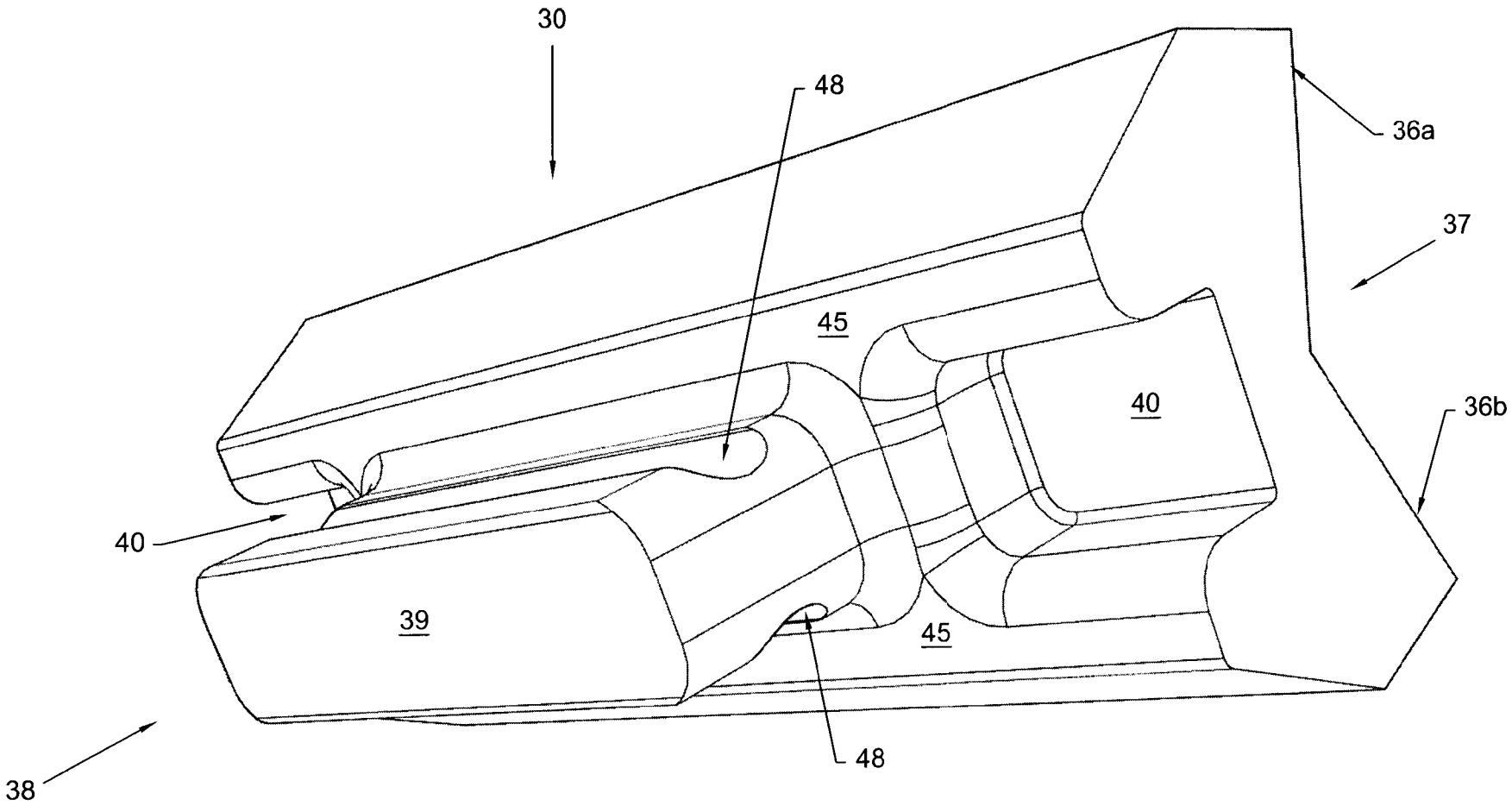
FIG. 10 is a perspective view of the hammer of the second embodiment of the invention.
Figure 11:
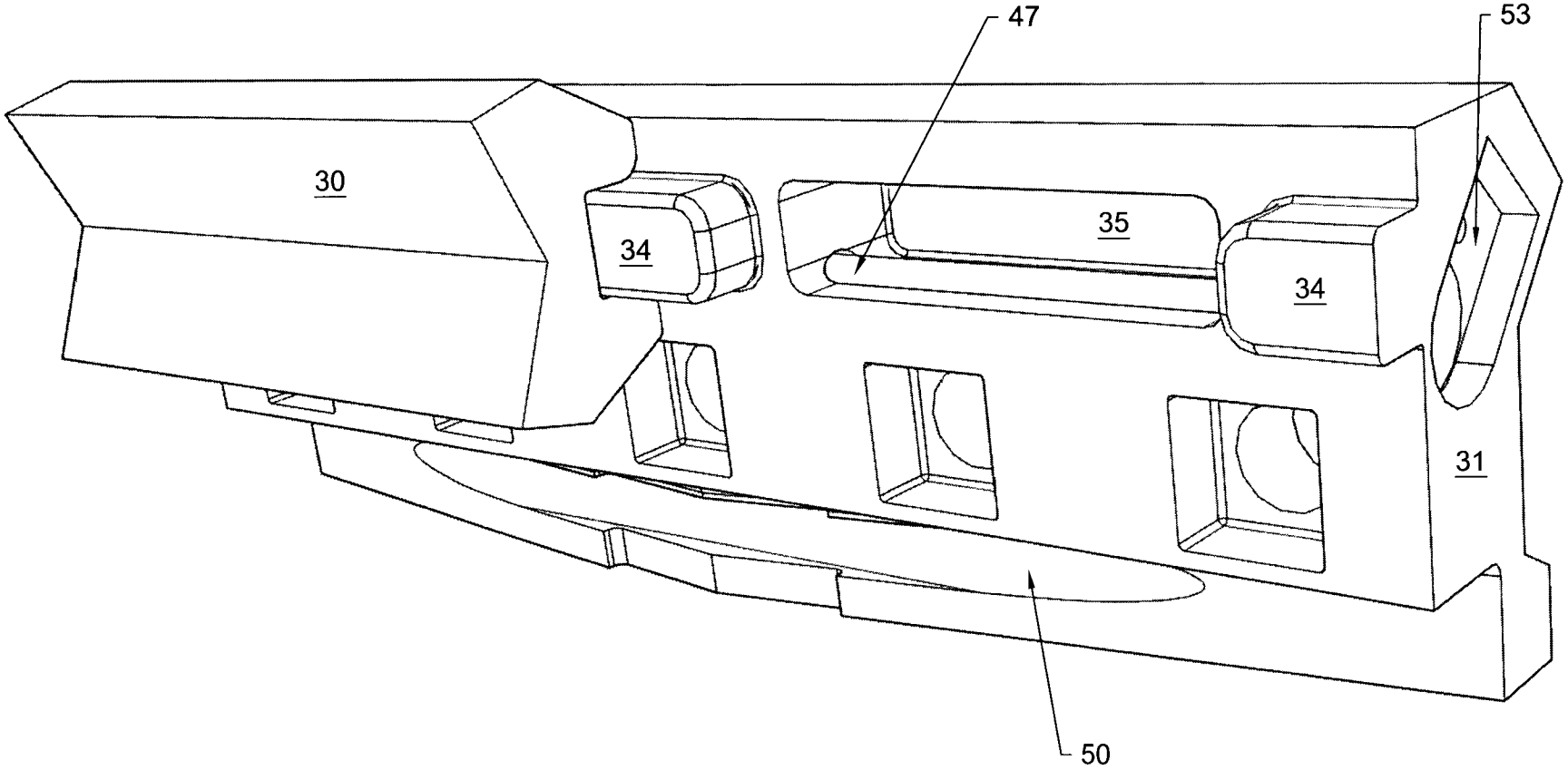
FIG. 11 is a perspective view of a single hammer attached to an adaptor of the second embodiment of the invention.
Figure 12:
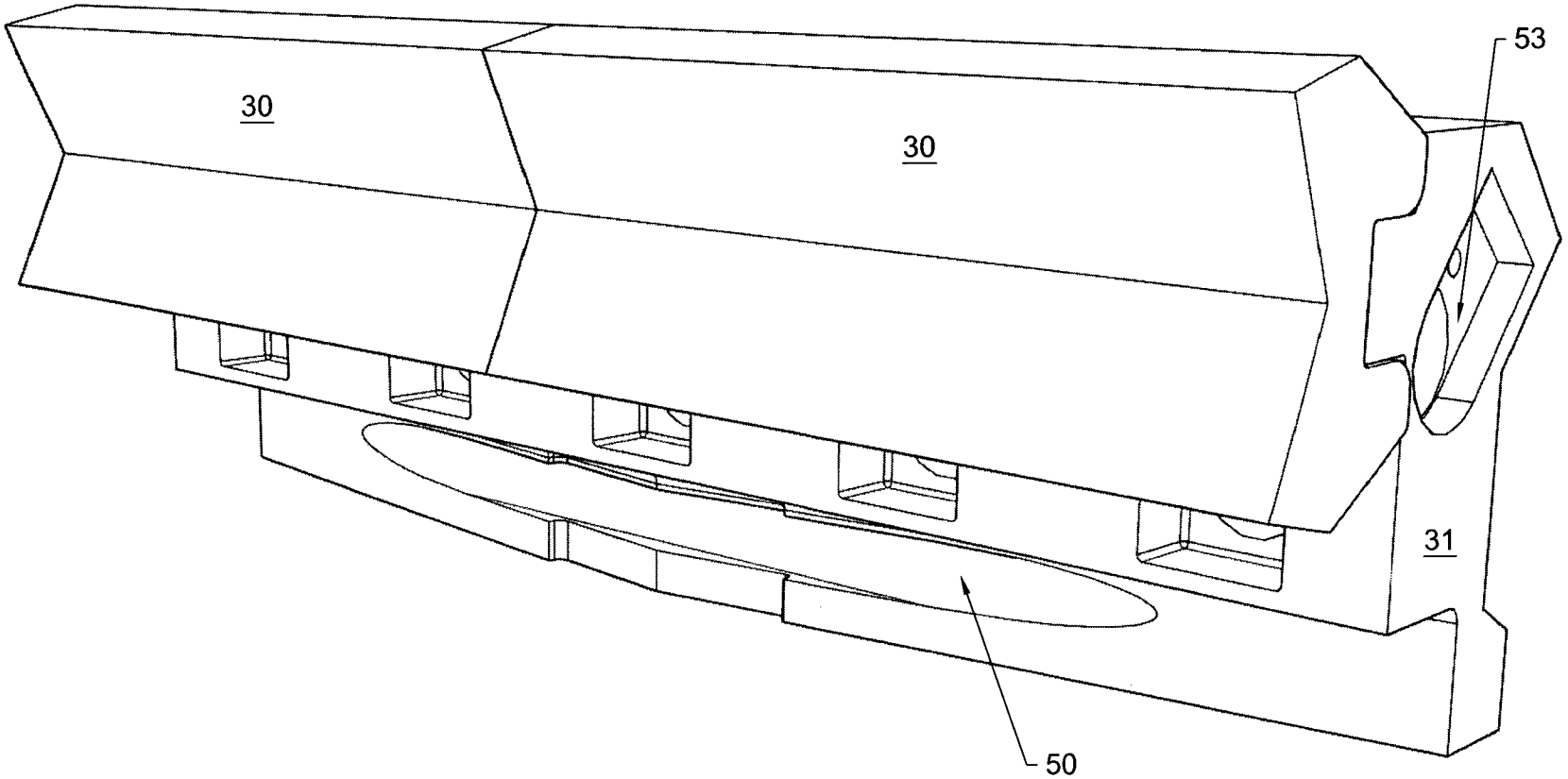
FIG. 12 is a perspective view of a pair of hammers attached to an adaptor of the second embodiment of the invention.

FIG. 10 shows hammer 30 of the invention having two impact surfaces 36*a* and 36*b*. The preferred embodiment of the invention features a hammer with two impact surfaces, to enable reversing the orientation of the hammer when one of the impact surfaces is worn. FIGS. 11 and 12 show perspective views of the adaptor 31 of the invention having one and two hammers 30, respectively.

The two impact surfaces are disposed at an impact portion 37 of the hammer. On a back portion of the hammer is a mounting portion 38 of the hammer, for engagement with the hammer mounting portion 33 of the adaptor. The mounting portion 38 of the hammer includes a ridge 39 extending in the direction of the longitudinal axis of the hammer and cavities 40. When the hammer 30 is mounted to the adaptor 31, the cavity portions 40 of the hammer mate with the ridges 34 of the adaptor 31, to form a tongue and groove type engagement. In a like manner, the cavity 35 of the adaptor 31 mates with the ridge 39 of the hammer 30 to form a tongue and groove type engagement.

Figure 14A:
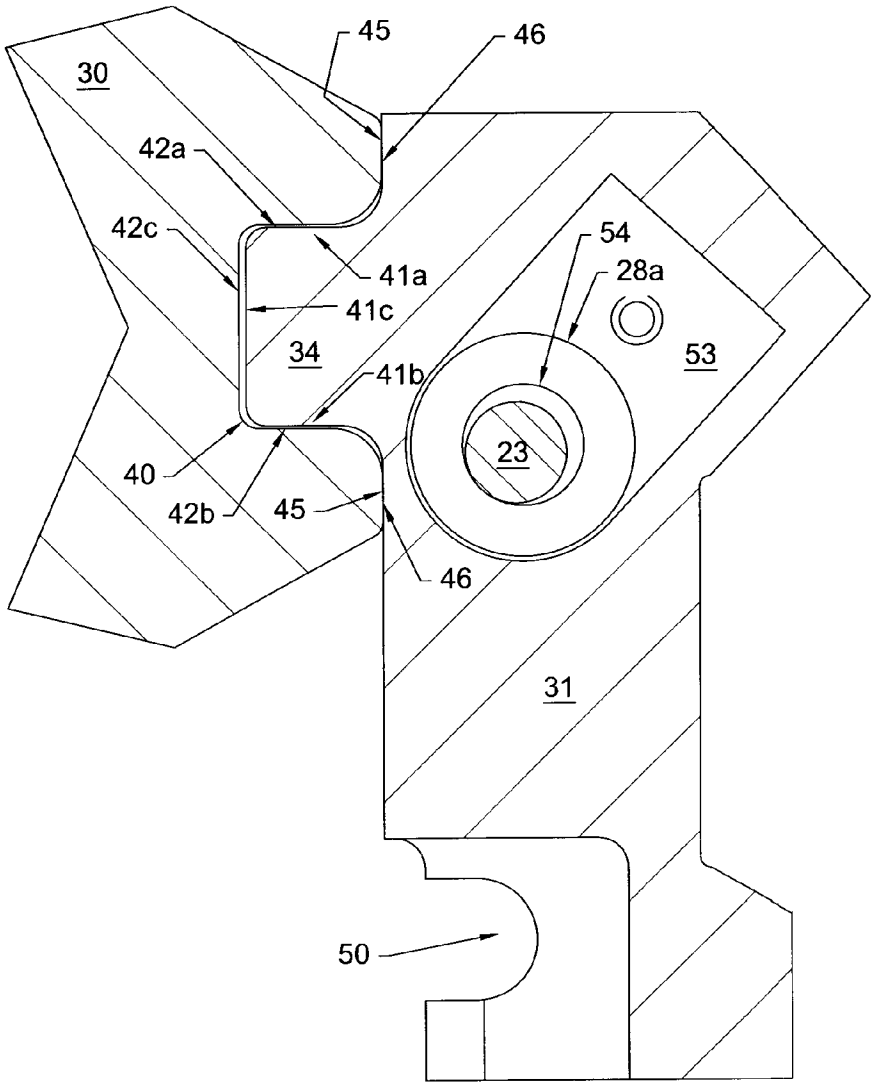
FIGS. 14*a* to 14*g* are cross-sectional views in various planes perpendicular to the longitudinal axes of the adaptor, as indicated in FIG. 13, for showing various features of the second embodiment of the hammer assembly of the invention.
Figure 14B:
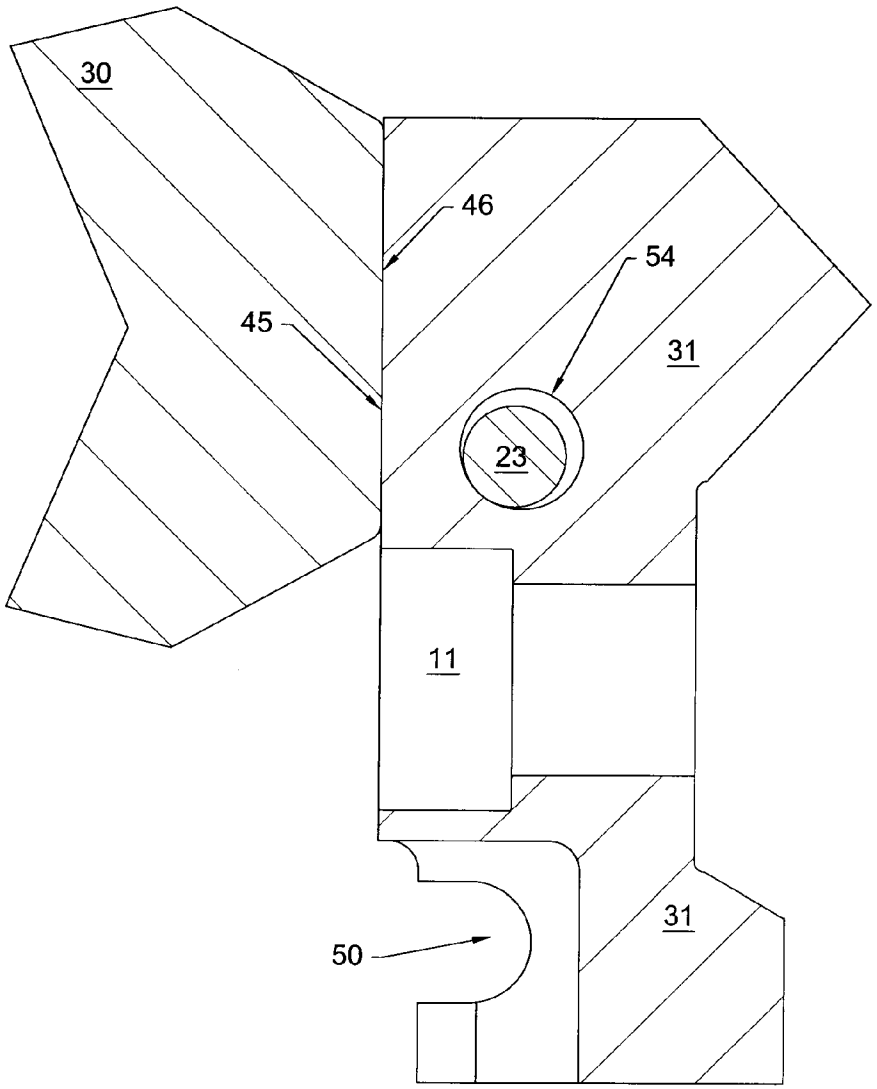
Figure 14C:
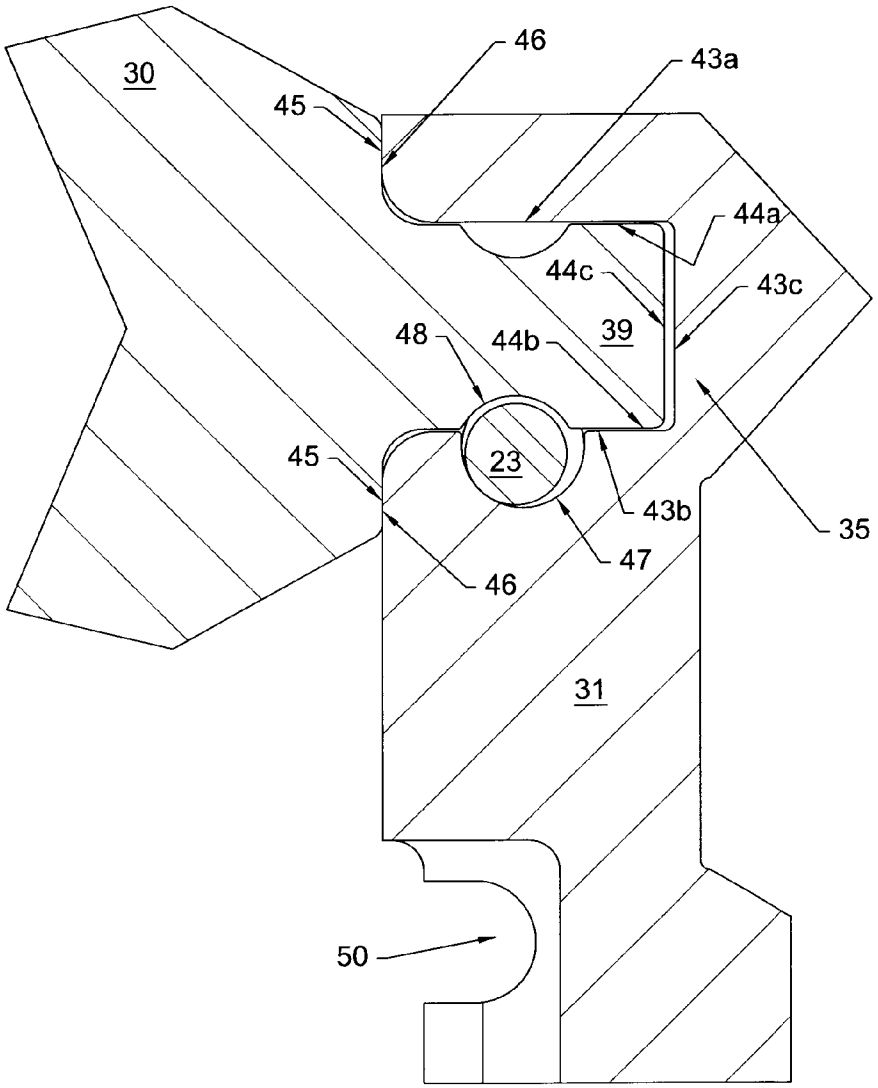

Referring to FIGS. 14*a* and 14*c*, surfaces of the ridges and groove of the adaptor and surfaces of the ridge and grooves of the hammer, which oppose each other when the hammer is mounted, are oriented such that surfaces 41*a* and 41*b* of the ridge of the adaptor and surfaces 42*a* and 42*b* of the groove of the hammer face substantially in the direction of centrifugal forces resulting from rotation of the rotor. Also surfaces 43*a* and 43*b* of the cavity of the adaptor and surfaces 44*a* and 44*b* of the ridge of the hammer face substantially in the direction of centrifugal forces resulting from rotation of the rotor. Surface 46 of the adaptor and surface 45 of the hammer face substantially in the direction of impact forces resulting from the impact of material being crushed with the impact surfaces 36*a* or 36*b* of the hammer. Surfaces 46 and 45 are shown also in FIGS. 9 and 10, respectively. Still further, surface 41*c* of the ridge 34 of the adaptor does not contact the hammer 30, and surface 44*c* of the ridge 39 of the hammer does not contact the adaptor 31. Therefore, surfaces 41*c* and 44*c* are not bearing surfaces as are the other surfaces mentioned above.

As mentioned above in regard to the first embodiment of the invention, the impact forces must be seriously considered as they are of a high magnitude, and any means for retaining the hammer on the adaptor must be able to remain in a condition that makes removal of the retainer means still possible after being subjected to the impact forces over a period of time.

FIGS. 8, 11 and 12 show hammer 30 mounted on adaptor 31. To prevent demounting of the hammer from the adaptor, a retainer rod 23, shown in perspective in FIG. 5, is used. The retainer rod passes through a retainer rod groove 47 in the adaptor 31, as well as through one of two retainer rod grooves 48 in the hammer. The retainer rod grooves 47 and 48, are disposed in a direction of the longitudinal axes of the adaptor and hammer as shown in FIGS. 9 and 10. The alignment of the retainer rod 23 through the retainer rod grooves 47 and 48 of the adaptor and hammer, respectively, is shown in FIG. 14*c*. The retainer rod grooves face each other when the hammer is mounted on the adaptor.

The relative sizes of the retainer rod 23 and the retainer rod grooves 47 and 48 of the adaptor and hammer, respectively, is an important feature of the invention. The retainer rod 23 is dimensioned to pass freely through the retainer rod grooves which are facing each other to form a cavity. A preferred clearance between the retainer rod 23 and each of the retainer rod grooves is about 10 mils. Although the retainer rod grooves facing each other preferably have the same radius, it is not required that a radius of the retainer rod groove of the adaptor and a radius of the retainer rod groove of the hammer be exactly the same. It is only important that the retainer rod is free from any impact forces of the hammers when the hammers are contacting the material to be crushed. Also, in order to maximize the cross section of the ridge 39 of the hammer, the retainer rod groove 48 of the hammer preferably is more shallow than the pressure rod groove 47 of the adaptor, as best shown in FIG. 14*c*.

An important feature of this embodiment of the invention is that the above-described cavity is formed by the facing retainer rod grooves when surfaces 45 and 46 of the hammer and adaptor, which face in the direction of the impact forces, are in contact with each other, as would be the case when the hammers are encountering material to be crushed. With such an arrangement, impact forces are transferred from the hammer 30 to the adaptor 31 when impact forces from crushing material are present, with the retainer rod 23 being free from any of the impact forces.

This feature of having the retainer rod being free from any of the impact forces is common to both the first and second embodiment of the invention. The locations of the retainer rod grooves 47 and 48 in relation to various surfaces of the hammer and adaptor are considered in order that none of the impact force is applied to any portion of the retainer rod 23 or retainer rod grooves 47 and 48. Such consideration is important so that when removal of the hammer is necessary, the retainer rod and retainer rod grooves are not deformed in any way that would prevent the retainer rod from being easily pulled out of the retainer rod grooves. Referring to FIGS. 14*c* and 14*f*, when the hammer impacts the material being crushed, surface 45 of the hammer 30 bears on surface 46 of the adaptor 31 to transfer the impact from the hammer to the adaptor, and in turn to the rotor. When the hammer is in the position shown in FIGS. 14*c* and 14*f*, relative to the adaptor, a clearance remains between the retainer rod grooves 47 and 48, and the retainer rod 23, so that no impact force is applied to the retainer rod. When the rotor is not in motion, or not encountering material to be crushed, the hammer may move in relation to the adaptor to separate the above recited bearing surfaces, and thus apply a force on the retainer rod 23 resulting from the weight of the hammer, for example, however such force does not deform the retainer rod in any manner.

Figure 13:
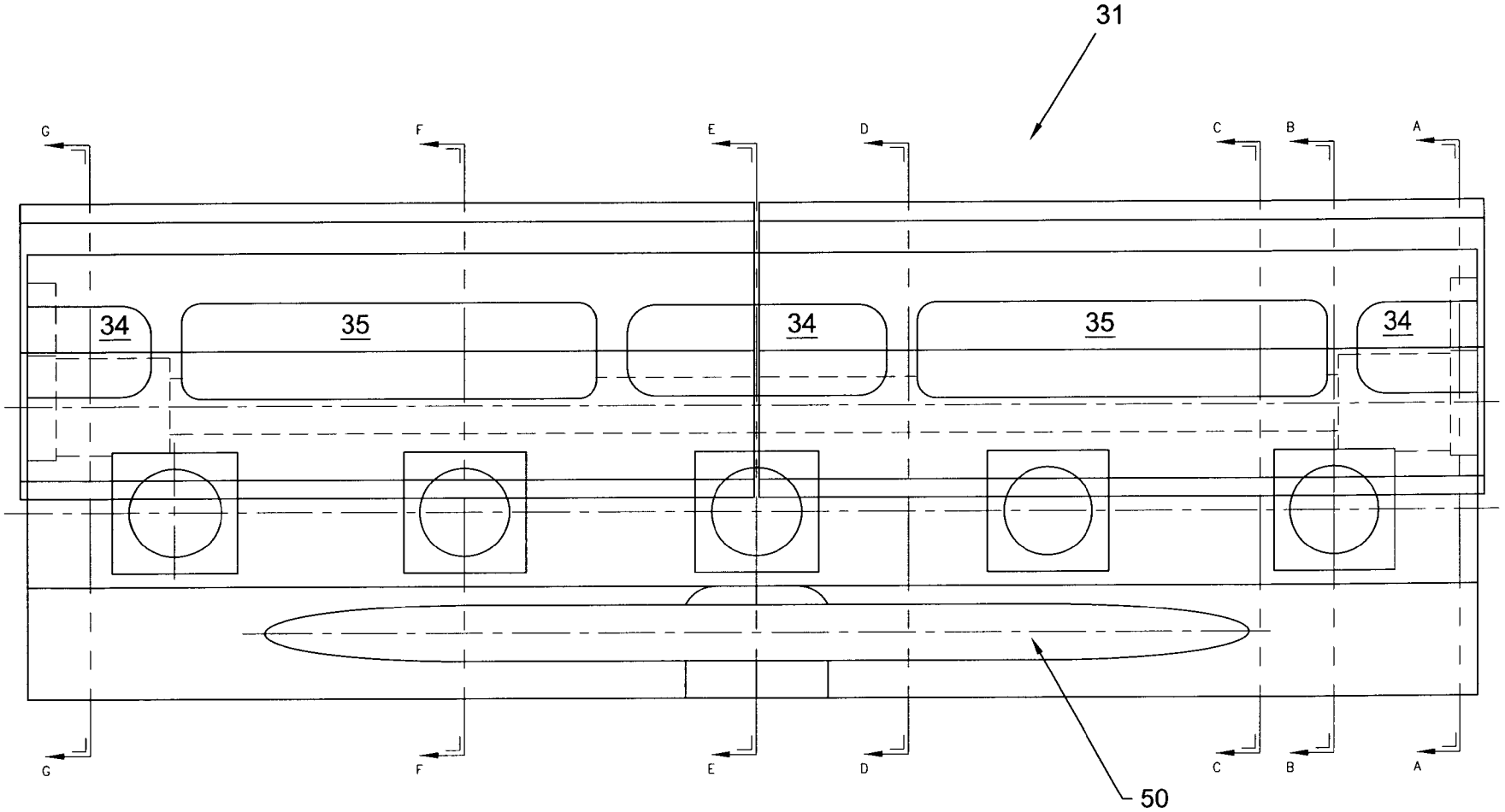
FIG. 13 is a front view of the adaptor of the second embodiment of the invention for indicating locations for cross-sectional views of FIGS. 14*a* to 14*g;*

FIGS. 14*a* to 14*g* show cross-sectional views of components of the hammer assembly at sections perpendicular to the longitudinal axes of the hammer, the adaptor, and the rotor. FIG. 13 shows dashed lines AA to GG indicating the locations of the cross-sectional views shown in FIGS. 14*a* to 14*g*, respectively.

FIG. 14*a* is a cross-sectional view taken at a location indicated by dashed line AA having a ridge 34 of the adaptor and a cavity 40 of the hammer. Recessed portion 50 at a lower portion of the adaptor is for use in attaching the adaptor to the rotor, and does not form part of the invention. The bearing surfaces 45 and 46 are clearly shown in FIG. 14*a* and the remaining cross-sectional view drawings.

FIG. 14*b* is a cross-sectional view taken at a location indicated by dashed line BB having neither a ridge of the hammer or adaptor, or a cavity of the hammer or adaptor. The opening 11 is solely for securing the adaptor to the rotor and does not form part of the invention.

FIG. 14*c* is a cross-sectional view taken at a location indicated by dashed line CC having a ridge 39 of the hammer and a cavity 35 of the adaptor. The relationships of the opposing surfaces are described above.

Figure 14D:
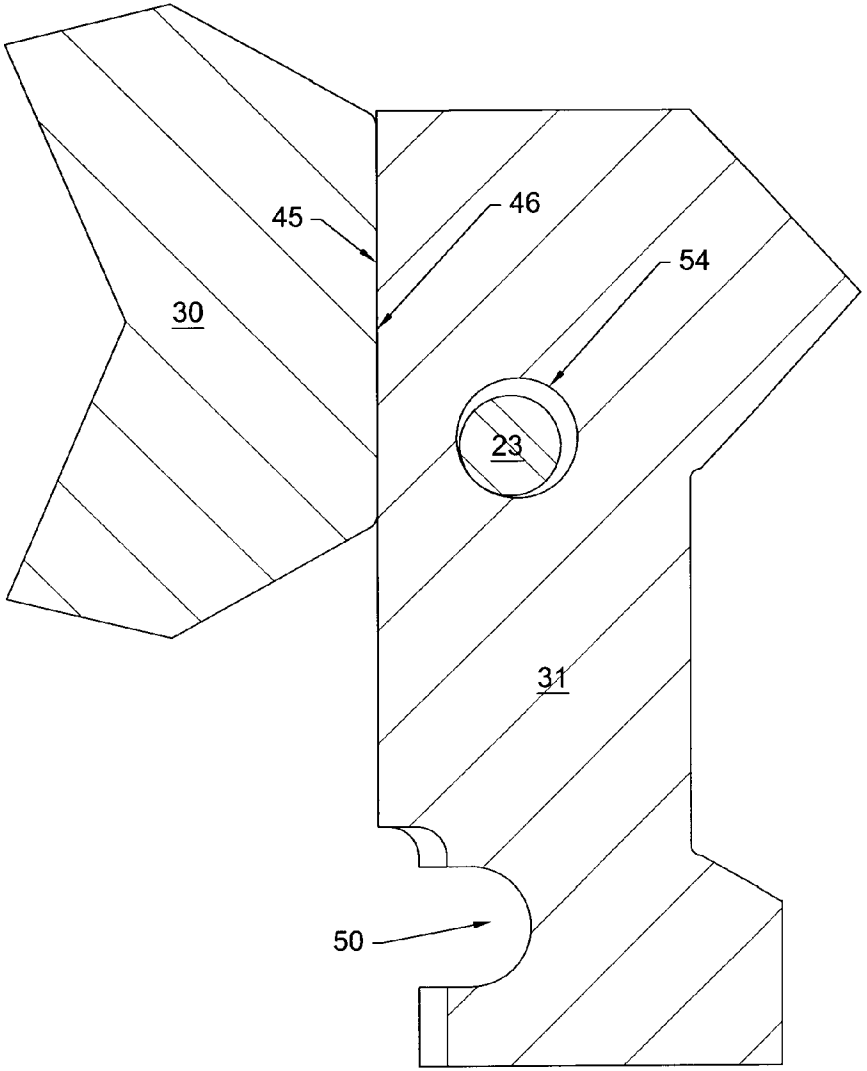

FIG. 14*d* is a cross-sectional view at a location indicated by dashed line DD having features similar to those of FIG. 14*b*, however an opening 11 is not present.

Figure 14E:
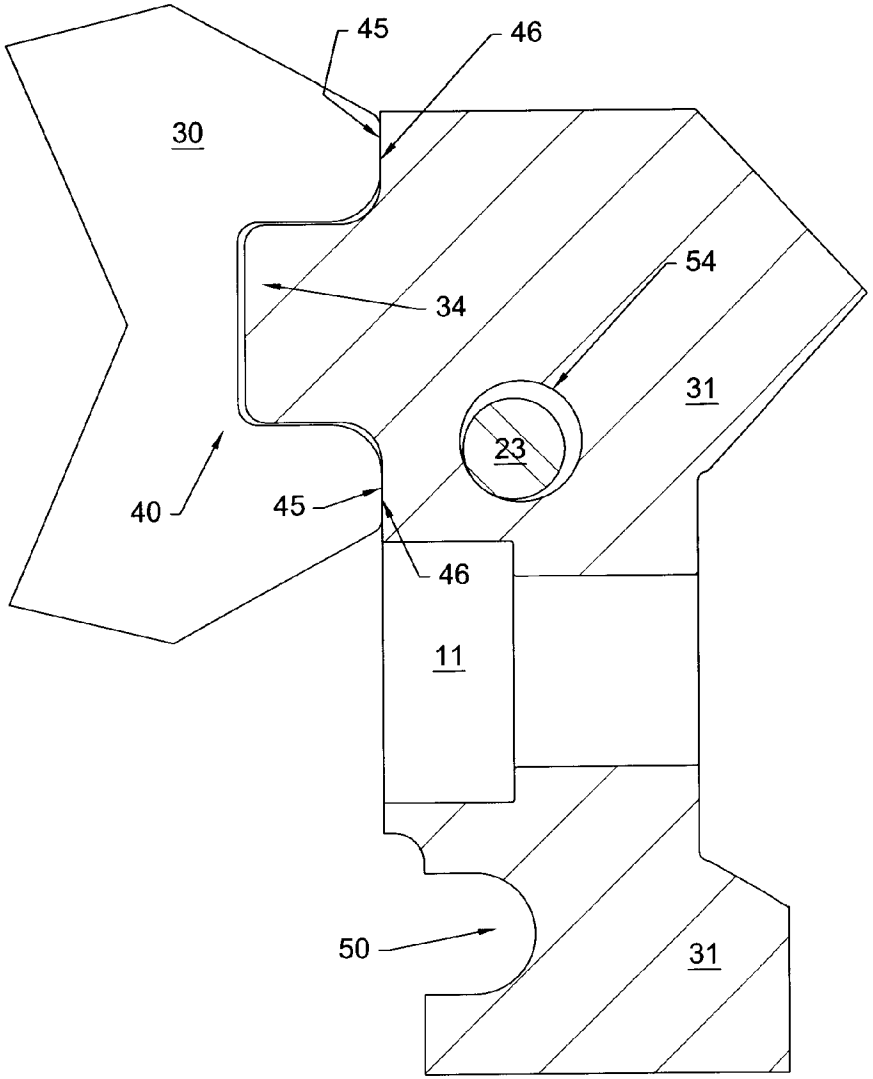
Figure 14F:
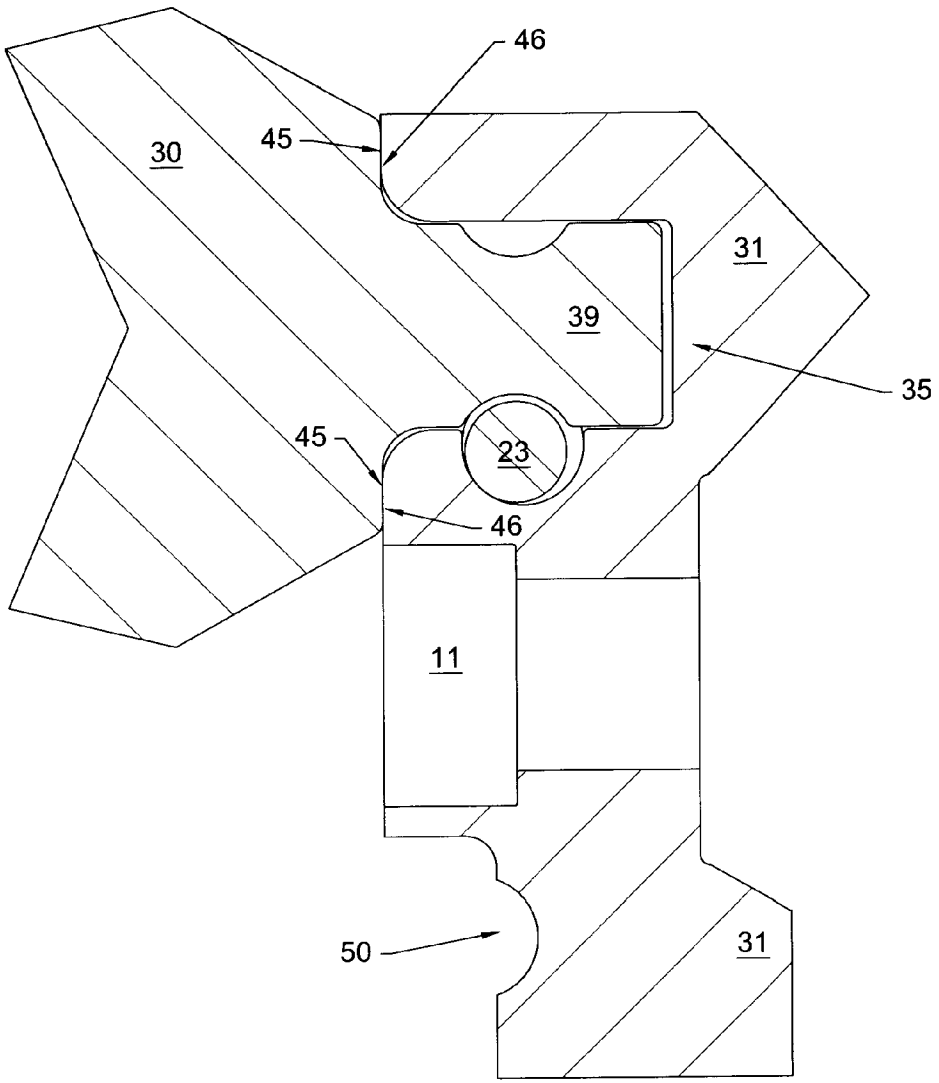

FIG. 14*e* is a cross-sectional view taken at a location indicated by dashed line EE having a ridge 34 of the adaptor. An end face of hammer 30 is shown as a non-sectioned surface, as the cross-sectional view is taken between two hammers. Also present are cavity 50 and opening 11, which are described above.

FIG. 14*f* is a cross-sectional view taken at a location indicated by dashed line FF having a ridge 39 of the hammer and a cavity 35 of the adaptor. The relationships of the opposing surfaces are described above. Also present are the cavity 50 and opening 11, which are also described above.

Figure 14G:
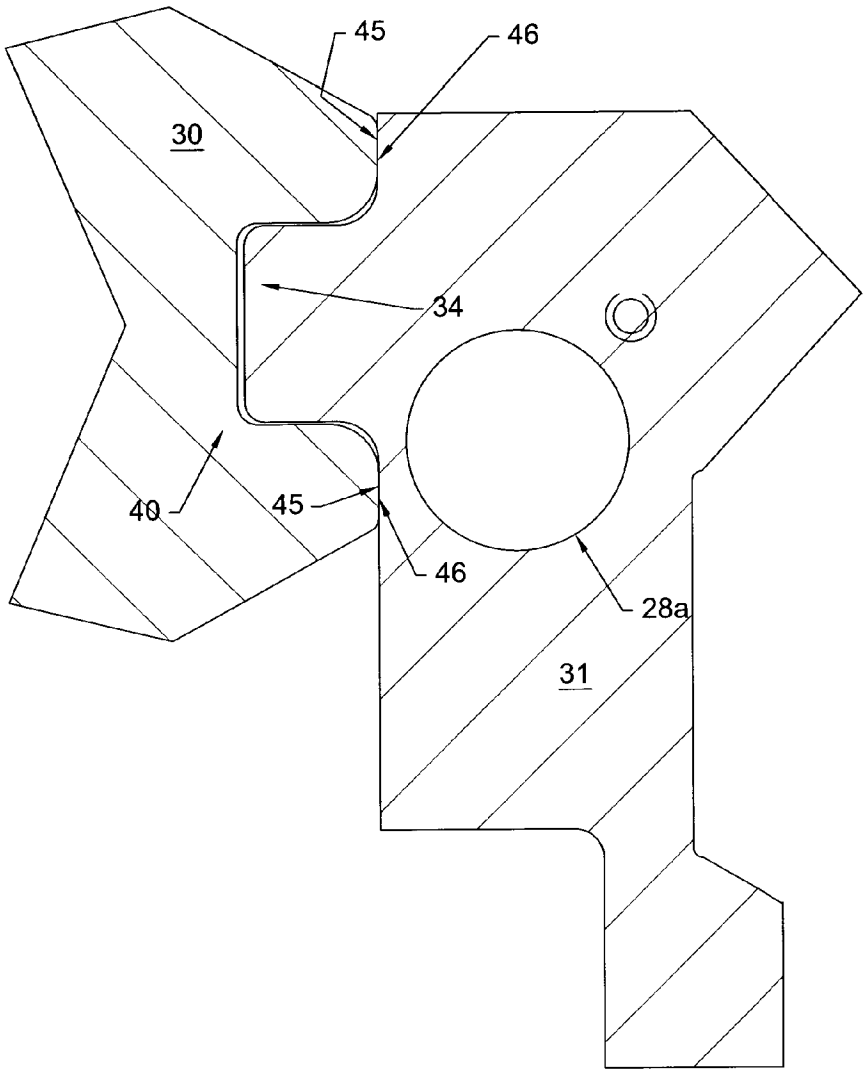

FIG. 14*g* is a cross-sectional view taken at a location indicated by dashed line GG having a ridge 34 of the adaptor and a cavity 40 of the hammer. A recessed portion at 54 is described below.

It can be seen in FIGS. 9, 14*a*, 14*b*, 14*d* and 14*e* that retainer rod groove 47 of the adaptor transitions to a cylindrical bore 54 at various portions of the adaptor that are away from the cavities 35. The retainer rod grooves 47 and cylindrical bore 54, preferably have the same radius and a common central axis.

As discussed above, retainer rod 23 is inserted into the cavity formed by the retainer rod grooves 47 and 48 facing each other, as best shown in FIG. 14*c*, and into the cylindrical bore 54 of the adaptor, to prevent demounting of the hammer from the adaptor. It is necessary to insert the retainer rod in a direction from one end of the rotor to the opposite end of the rotor, as shown in FIG. 8. However it is not necessary to remove the hammers by sliding them out in the same direction as for the retainer rod, as after the retainer rod is removed, the hammer can be removed by pulling it outwardly in a direction indicated by arrow (A) in FIG. 8. As mentioned above, a rotary crushing machine most often has side plates near ends of the rotor and access to end portions of the rotor are difficult.

In the present embodiment of the invention, only a small access hole in one of the side plates of the machine is required for use in mounting the hammers and removing the hammers when replacement is necessary. Alternatively, the adaptor can be removed from the rotor prior to replacing the hammer, however more time and labor is necessary when doing such. To mount the hammers 38 to the adaptor 31 the grooved portions 40 and ridge portion 39 of the hammers are placed over the ridges 34 and groove 35 of the adaptor, as shown in FIG. 12. Next, the retainer rod 23 is inserted to pass through the cavity formed by retainer rod groove 47 in the adaptor and retainer rod grooves 48 in the hammers, and the cylindrical bores 54.

In order to keep the retainer rod 23 in place, a keeper plate 51, as shown in FIG. 8, is bolted into place. It is important that the keeper plate and the head of the bolt 52 be below the plane of the end of the rotor, so as not to make contact with the side plates of the machine which are disposed near ends of the rotor. As shown in FIGS. 9, 11, 12 and 14*a*, a keeper plate recess 53 is formed at an end of the adaptor to accommodate the keeper plate and bolt head.

To replace a hammer it is necessary to retract the retainer rod in a direction opposite to that described above for inserting the rod. To facilitate the retracting a threaded coupling 29, as shown in FIG. 5, is attached to the retainer rod prior to inserting the retainer rod when mounting the hammer to the adaptor. The threaded coupling can also be an integral part of the retainer rod. Preferably the threaded coupling has internal threads (female) into which an extraction tool (not shown), having external threads (male) of the same size and pitch can be threaded. After threading the extraction tool into the threaded coupling, force can be applied outwardly to remove the retainer rod from the hammer assembly.

With the attachment as described, the retainer rod can be rotated while applying the force to facilitate the extraction. By having internal threads on the threaded coupling, there is less chance that the threads will become damaged during operation of the machine. An additional recess, as shown at 28*a*, can be formed in the end of the adaptor to accommodate the threaded coupling as shown in FIGS. 14*a* and 14*g*.

In a preferred embodiment, the adaptor has recesses 53 and 28*a* in both ends to enable insertion of the retainer rod in either direction, as different rotary material crusher machines can be accessed easier on one side than the other.

Figure 15:
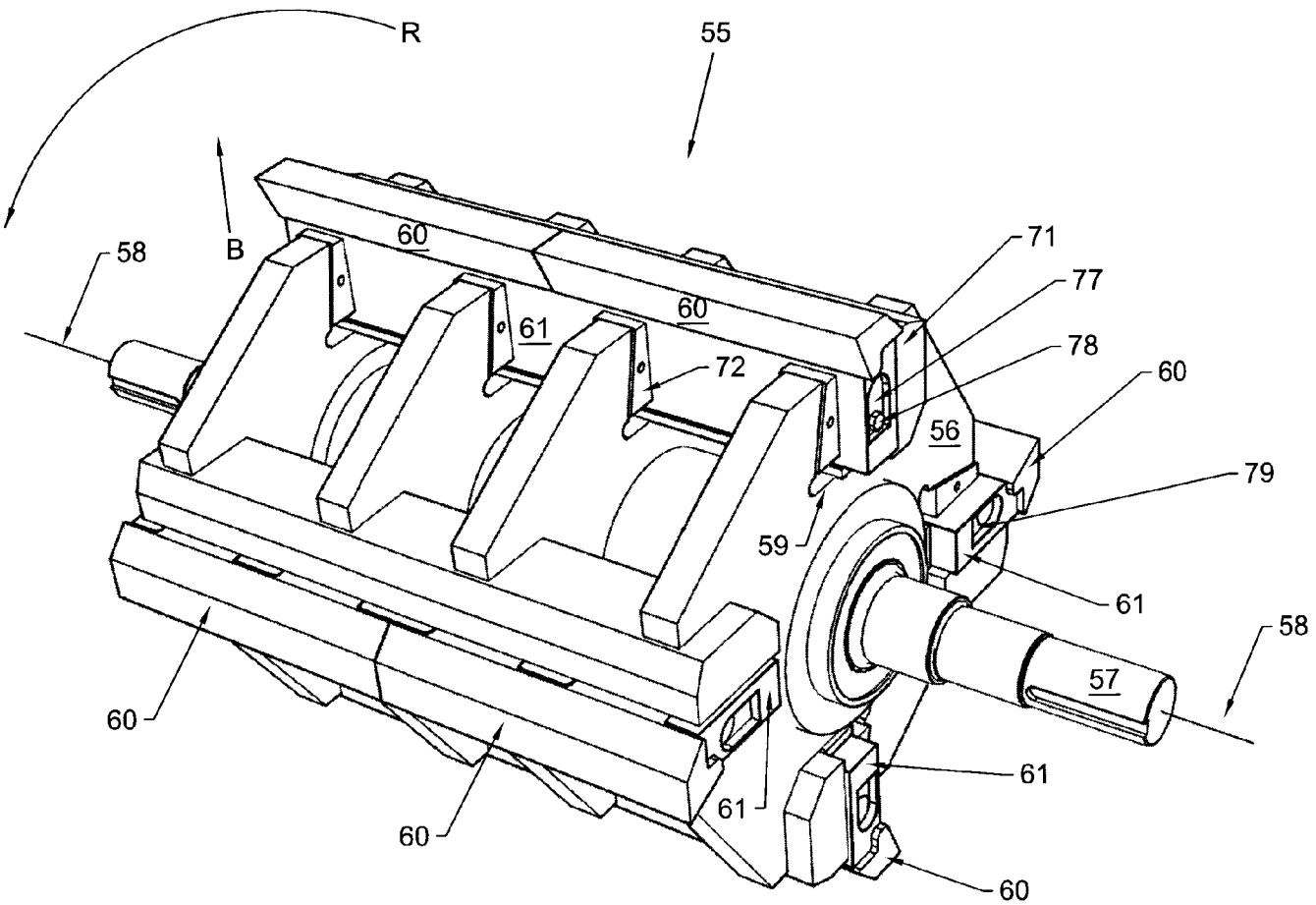
FIG. 15 is a perspective view of a third embodiment of the invention mounted to a rotor of a rotary material crusher.

A third embodiment of the invention is described with use of FIGS. 15 to 20. FIG. 15 shows a rotor 55 of a rotary material crusher. The rotor of this embodiment is for use in a rotary material crusher used in what is referred to in the art as a secondary application. That is for applications in crushing material of a smaller size than the material crushed with the embodiments 1 and 2 described above. The rotor has many of the same features as the rotor of the first and second embodiments of the invention. That is ends 56, a shaft 57 and an axis of rotation 58. Disposed at the peripheral portion of the rotor are at least two attachment grooves 59 for use in attaching at least two adaptors 61 and two hammers 60 to the rotor. In the embodiment shown in FIG. 15, four adaptors and four pairs of hammers are attached to the rotor. In the following disclosure only one hammer of a hammer assembly will be described, however it is to be understood that any number of attachment grooves 59 can be disposed circumferentially around the rotor, and any number of adaptors 61 and hammers 60 can be attached along the attachment groove 59.

Figure 16:
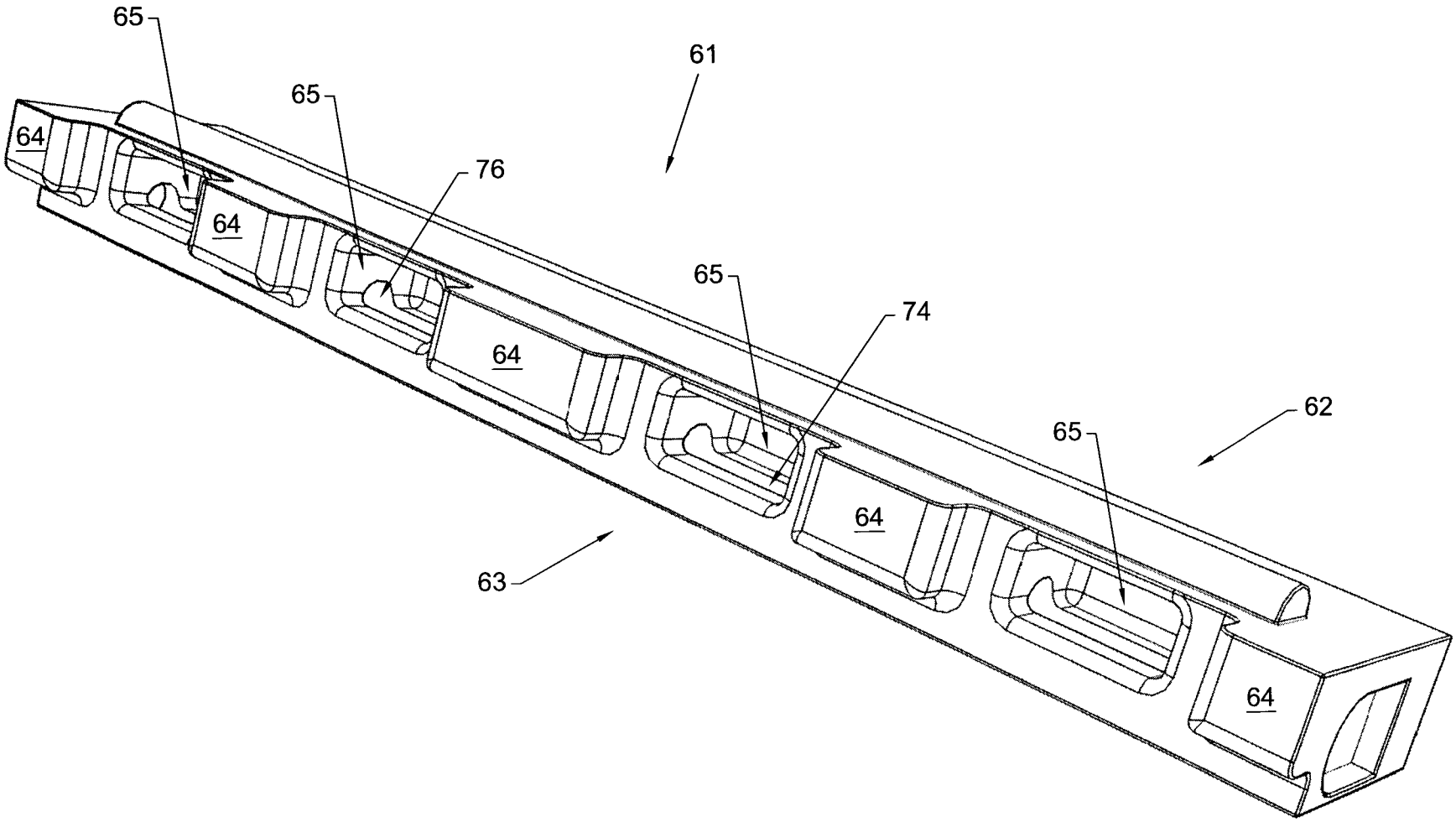
FIG. 16 is a perspective view of an adaptor of the third embodiment of the invention for use in attaching a hammer to the rotor.

In the present embodiment of the invention an adaptor 61, shown attached to the rotor in FIG. 15 and shown in perspective and unattached in FIG. 16, is attached to the rotor in attachment groove 59. The adaptor 61 is made up of a base portion 62 and a hammer mounting portion 63, as indicated in FIG. 16. The base portion 62 seats in attachment groove 59 of the rotor, as shown in FIG. 15, and can be secured to the rotor by any known means.

When the adaptor is attached to the rotor, the hammer mounting portion 63 of the adaptor preferably extends outward in a substantially radial direction in relation to the axis of rotation 58 of the rotor. The adaptor shown in FIGS. 15 and 16 is configured to accommodate two hammers, as shown in FIG. 15, however an adaptor of the invention can be configured to accommodate solely one hammer, or more than two hammers.

The hammer mounting portion 63 of the adaptor includes ridges 64 extending in the direction of a longitudinal axis of the adaptor and cavities 65, also extending in the direction of the longitudinal axis of the adaptor and in line with the ridges 64. The hammer 60 is configured to mate with ridges 64 and cavities 65 of the adaptor when mounted.

Figure 17:
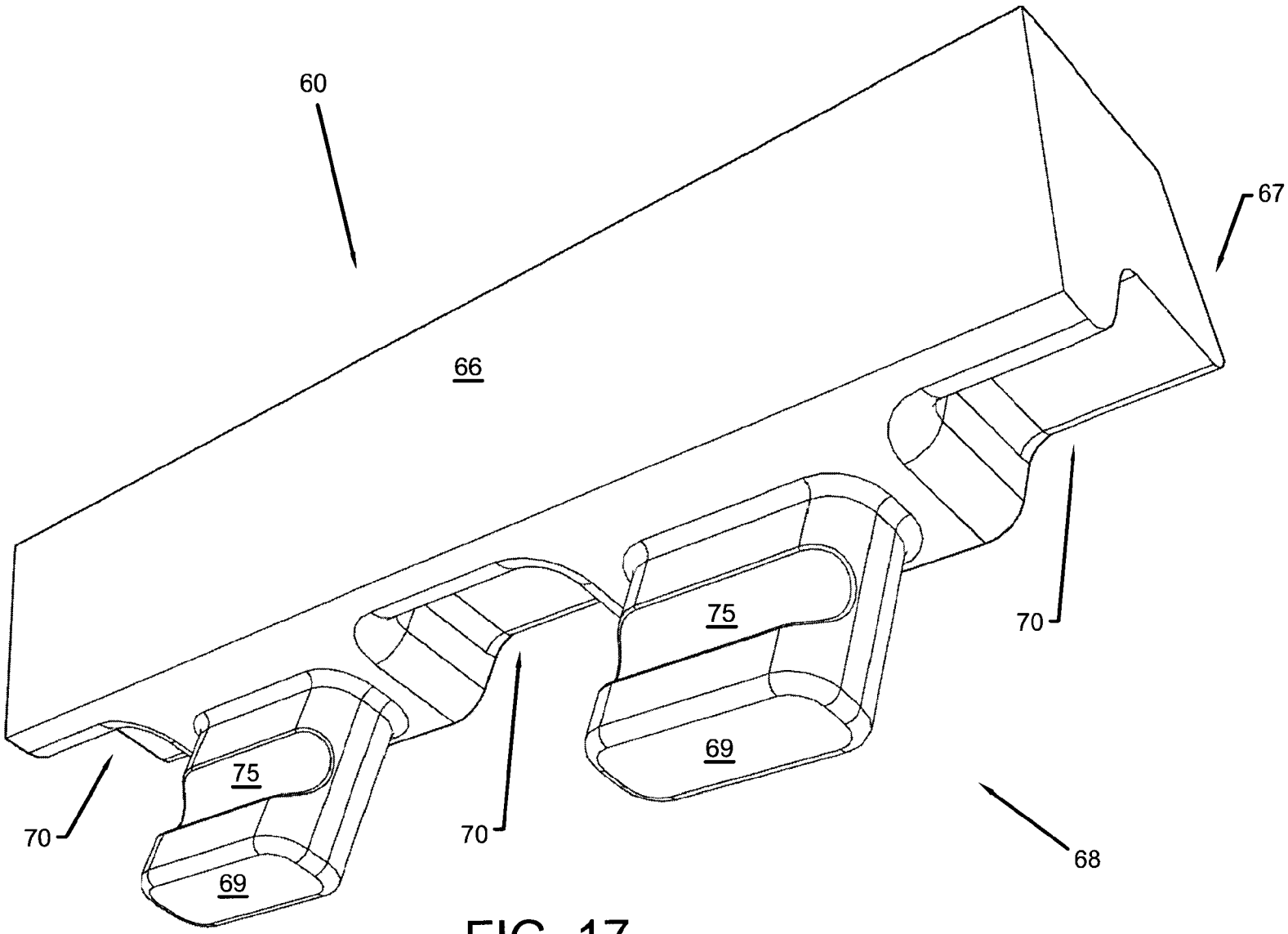
FIG. 17 is a perspective view of the hammer of the third embodiment of the invention.
Figure 18:
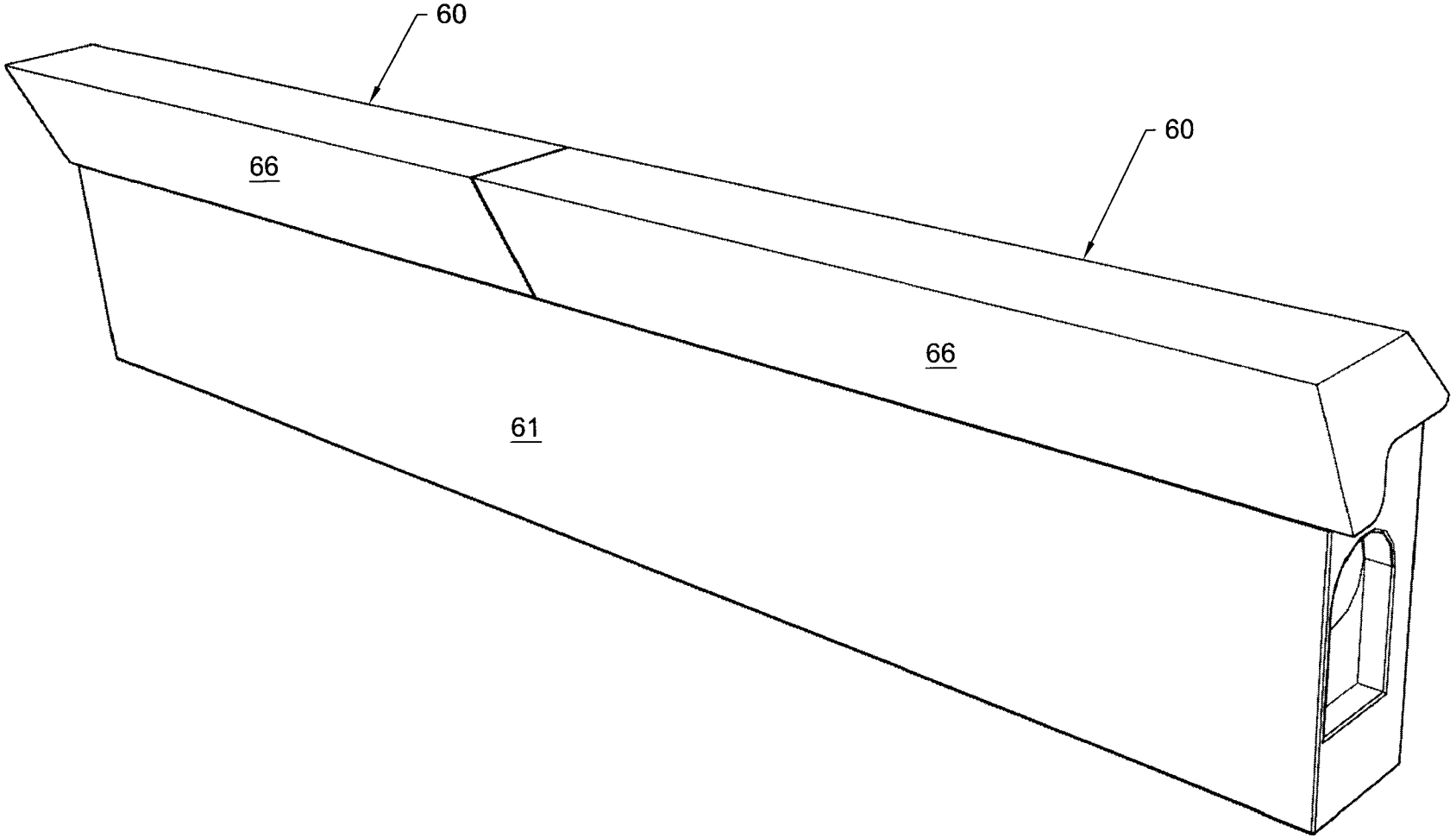
FIG. 18 is a perspective view of a pair of hammers attached to an adaptor of the third embodiment of the invention.

FIG. 17 shows a hammer 60 of the invention having impact surface 66. FIG. 18 shows a perspective view of the adaptor 61 of the invention having two hammers 60 attached.

The impact surface 66 of the hammer is disposed at an impact portion 67 of the hammer. On a lower portion of the hammer is a mounting portion 68 for engagement with the hammer mounting portion 63 of the adaptor. The mounting portion 68 of the hammer includes ridges 69 extending in the direction of the longitudinal axis of the hammer and cavities 70 in line with the ridges. When the hammer 60 is mounted to the adaptor 61, the cavity portions 70 of the hammer mate with the ridges 64 of the adaptor 61, to form a tongue and groove type engagement. In a like manner the cavities 65 of the adaptor 61 mate with the ridges 69 of the hammer 60 to form a tongue and groove type engagement.

Figure 20A:
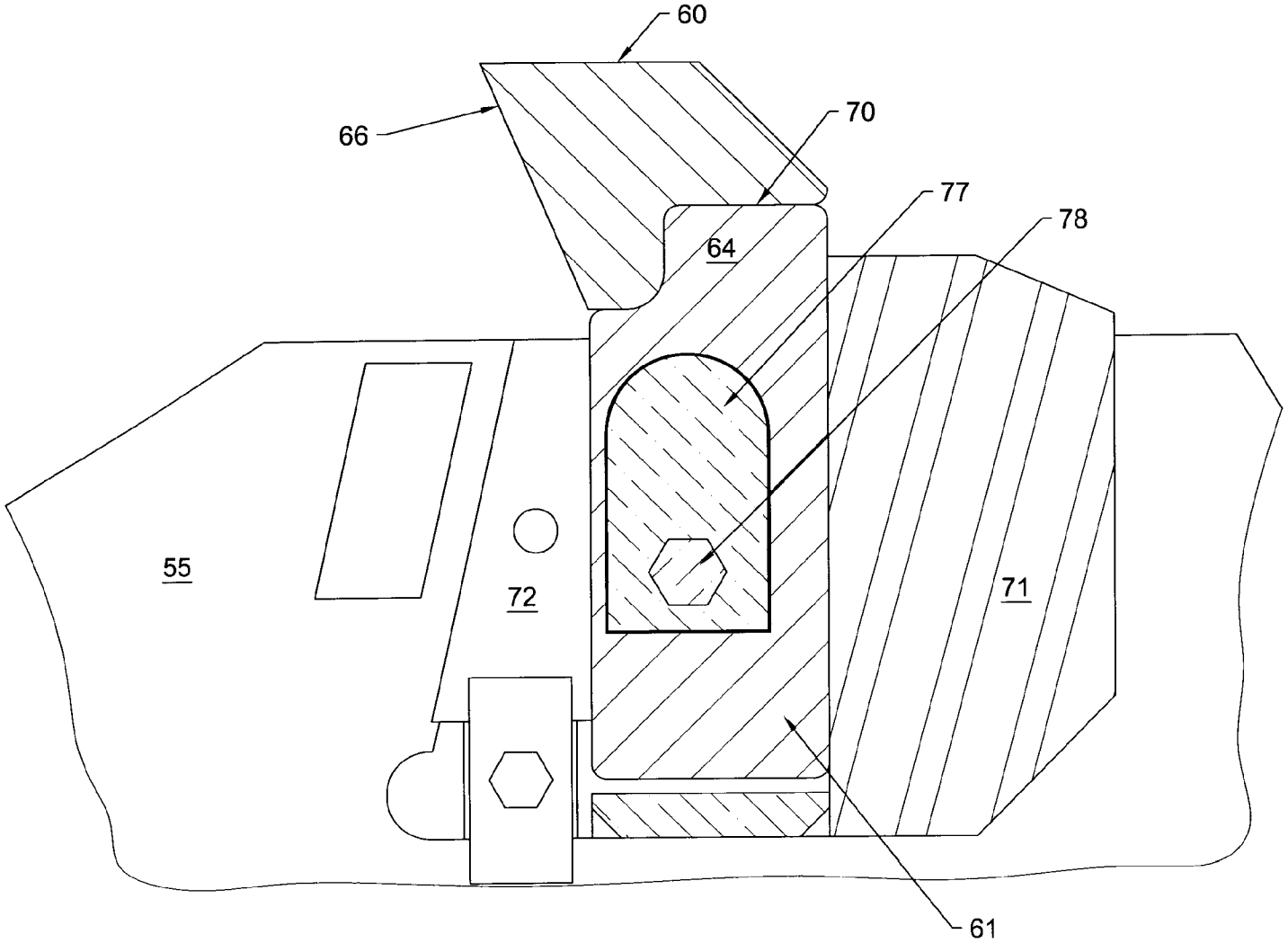
FIGS. 20*a* to 20*d* are cross-sectional views in various planes perpendicular to the longitudinal axes of the adaptor, as indicated in FIG. 19, for showing various features of the third embodiment of the hammer assembly of the invention.
Figure 20B:
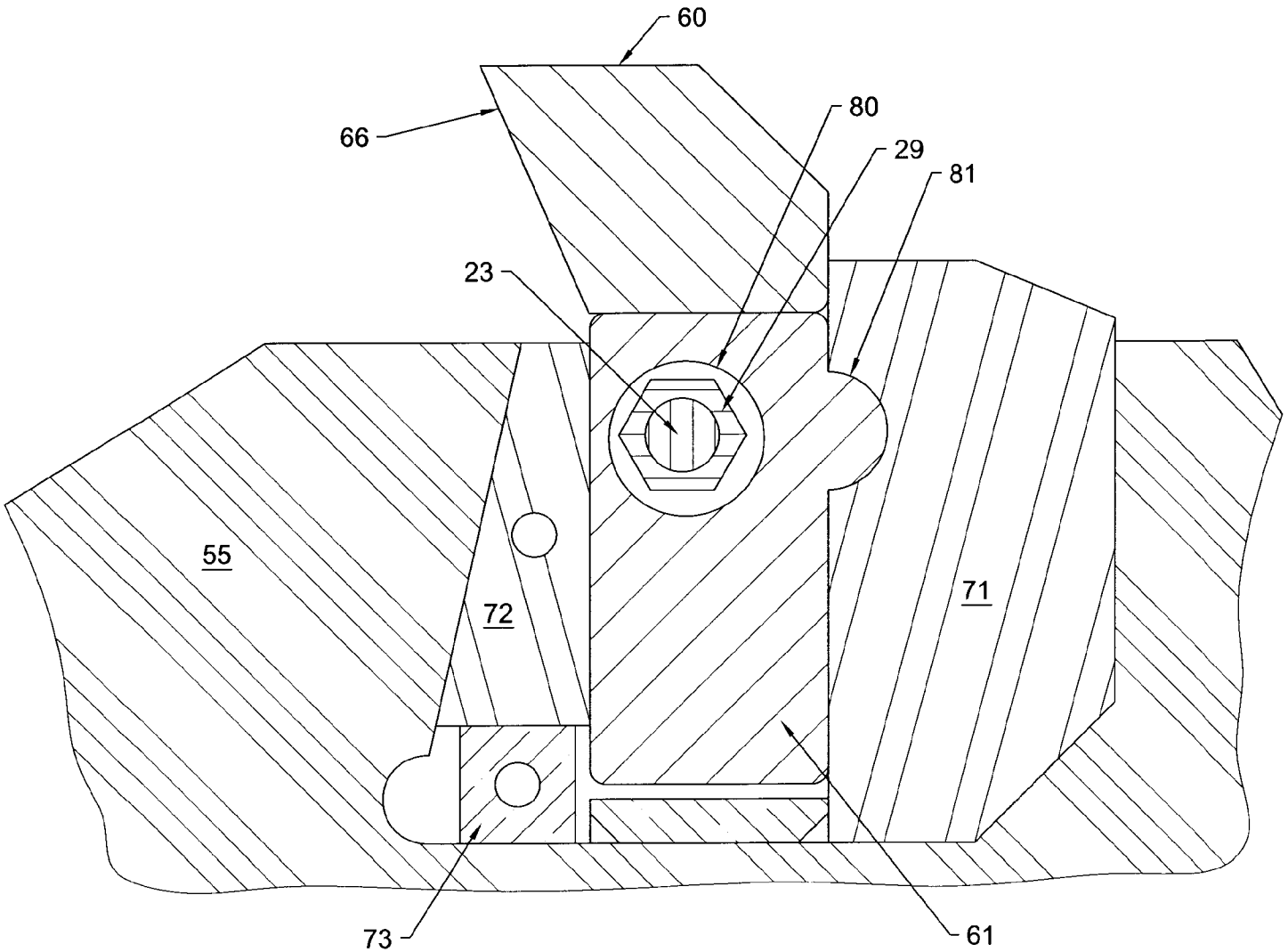
Figure 20C:
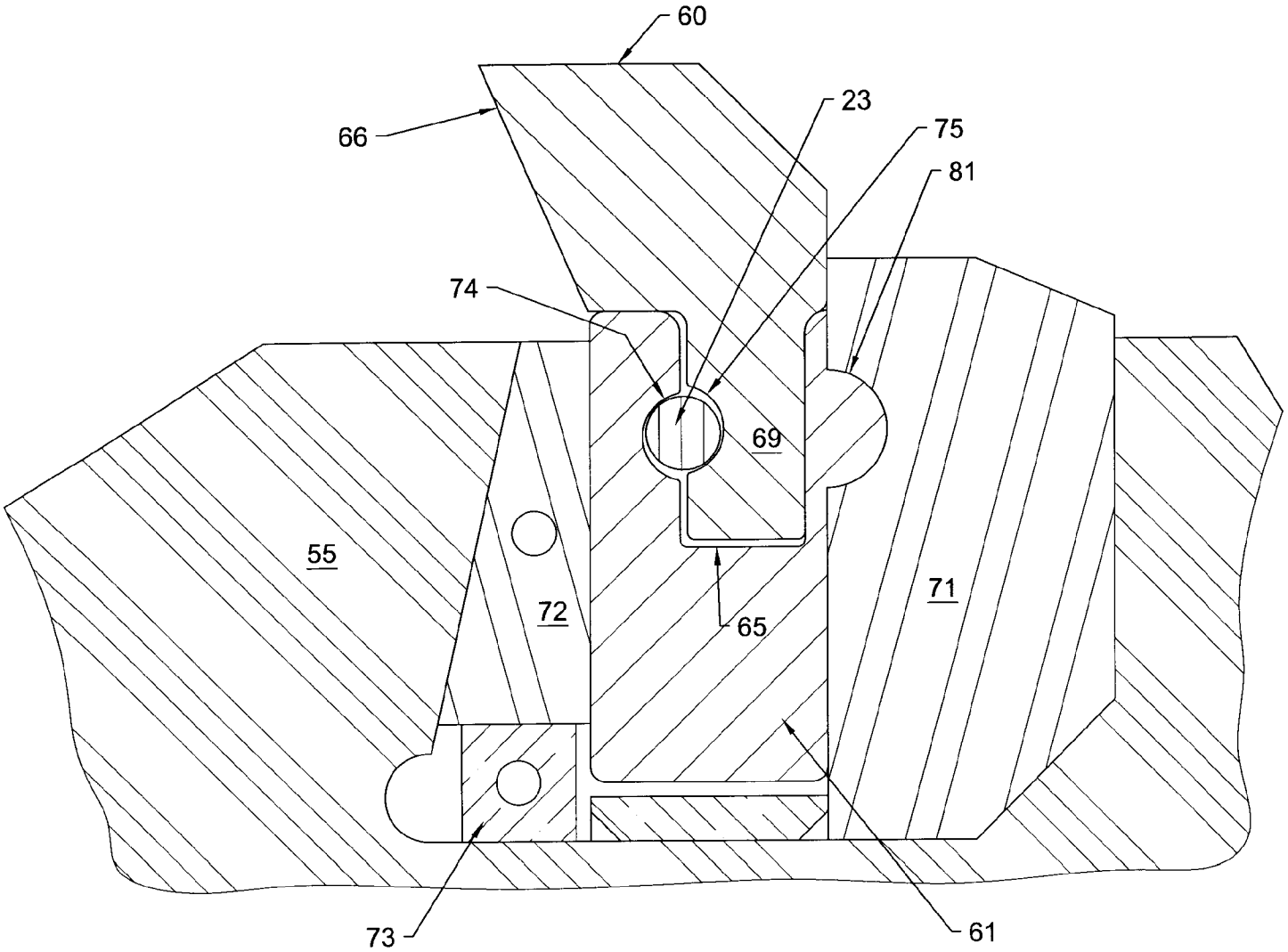

As best viewed in FIGS. 20*b* and 20*c*, wedging blocks 72 and 73, and a back-up bar 71 are used solely for attaching the adaptor 61 to the rotor 55, and form no part of the present invention.

As mentioned above in regard to the first and second embodiments of the invention, the impact forces must be seriously considered as they are of a high magnitude, and any means for retaining the hammer on the adaptor must be able to remain in a condition that makes removal of the retainer means still possible after being subjected to the impact forces over a period of time.

FIGS. 15 and 18 show hammers 60 mounted on adaptor 61. To prevent demounting of the hammer from the adaptor, retainer rod 23, shown in perspective in FIG. 5 is used. As best viewed in FIG. 20*c*, the retainer rod passes through a retainer rod groove 74 in the adaptor 61, as well as through a retainer rod groove 75 in the hammer. The retainer rod grooves face each other when the hammer is mounted. The retainer rod grooves 74 and 75, are disposed in a direction of the longitudinal axes of the adaptor and hammer as shown in FIGS. 16 and 17. In FIG. 16, grooves 74 and bores 76 are shown. The grooves 74 transition into the bores 76 in portions of the adaptor, as shown. The alignment of the retainer rod 23 through the retainer rod grooves 74 and 75 of the adaptor and hammer, respectively, is shown in FIG. 20*c*.

The relative sizes of the retainer rod 23 and the retainer rod grooves 74 and 75 of the adaptor and hammer, respectively, is an important feature of the invention. The retainer rod 23 is dimensioned to pass freely through the retainer rod grooves which face each other and together form a cavity having a dimension greater than a diameter of the retainer rod. A preferred clearance between the retainer rod 23 and each of the retainer rod grooves is about 10 mils. Although the radius of the retainer rod groove of the hammer and the retainer rod groove of the adaptor are preferably the same, such relationship is not required in practice of the invention. It is only important that the retainer rod is free from any impact forces of the hammers when the hammers are contacting the material to be crushed.

An important feature of this embodiment of the invention is that the cavity for the retainer rod is formed when surfaces of the hammer and adaptor which face in the direction of the impact forces are in contact with each other, as would be the case when the hammers are encountering material to be crushed. With such an arrangement, impact forces are transferred from the hammer 60 to the adaptor 61 when impact forces from crushing material are present, with the retainer rod 23 being free from any of the impact forces.

This feature of having the retainer rod being free from any of the impact forces is common to the first, second and third embodiments of the invention. The locations of the retainer rod grooves 74 and 75 in relation to various surfaces of the hammer and adaptor are considered in order that none of the impact force is applied to any portion of the retainer rod 23 or retainer grooves 74 and 75. Such consideration is important so that when removal of the hammer is necessary, the retainer rod and retainer rod grooves are not deformed in any way that would prevent the retainer rod from being easily pulled out of the retainer rod grooves.

Referring to FIG. 20*c* when the hammer is in the position shown relative to the adaptor, a clearance remains between the retainer rod grooves 74 and 75, and the retainer rod 23, so that no impact force is applied to the retainer rod. When the rotor is not in motion, or not encountering material to be crushed, the hammer may move in relation to the adaptor to separate bearing surfaces, and thus apply a force on the retainer rod 23 resulting from the weight of the hammer, for example, however such force does not deform the retainer rod in any manner.

Figure 19:
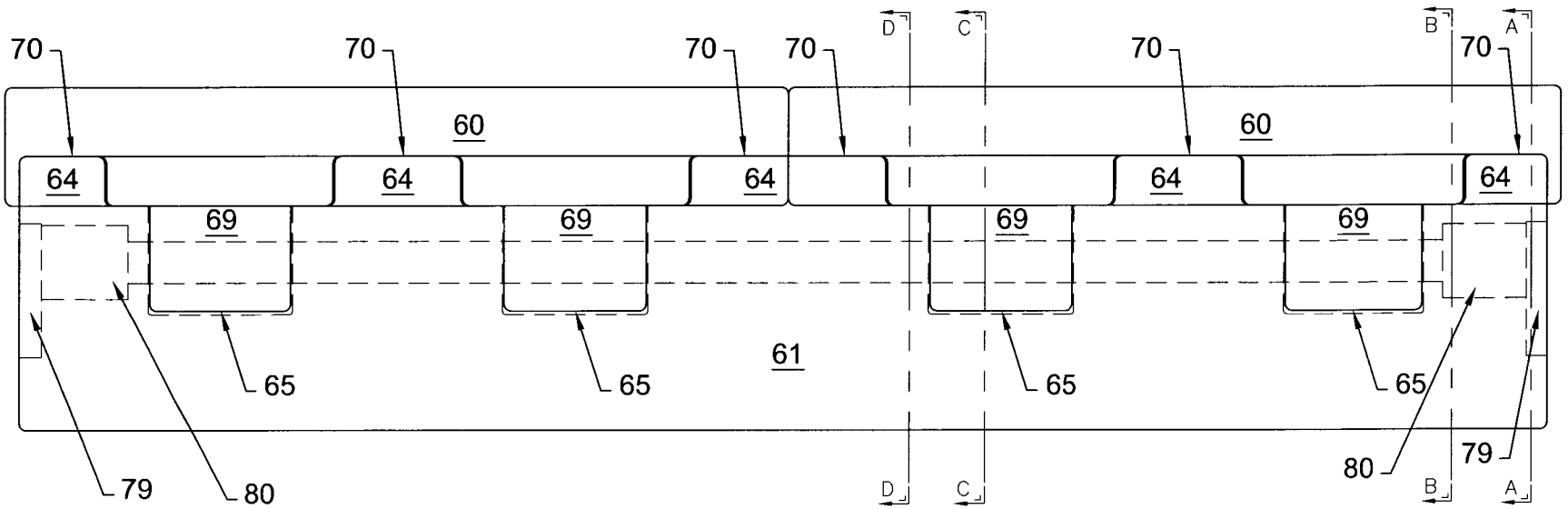
FIG. 19 is a front view of the adaptor of the third embodiment of the invention for indicating locations for cross-sectional views of FIGS. 20*a* to 20*d*.

FIGS. 20*a* to 20*d* show cross-sectional views of components of the hammer assembly at sections perpendicular to the longitudinal axes of the hammer, the adaptor, and the rotor. FIG. 19 shows dashed lines AA to DD indicating the locations of the cross-sectional views shown in FIGS. 20*a* to 20*d*, respectively.

FIG. 20*a* is a cross-sectional view taken at a location indicated by dashed line AA having a ridge 64 of the adaptor and a cavity 70 of the hammer.

FIG. 20*b* is a cross-sectional view taken at a location indicated by dashed line BB having neither a ridge of the hammer or adaptor, or a cavity of the hammer or adaptor. Projection 77 is solely for securing the adaptor to the back-up bar 71 and does not form part of the invention.

FIG. 20*c* is a cross-sectional view taken at a location indicated by dashed line CC having a ridge 69 of the hammer and a cavity 65 of the adaptor. The relationships between the grooves 74 and 75 and the retainer rod 23 are clearly shown.

Figure 20D:
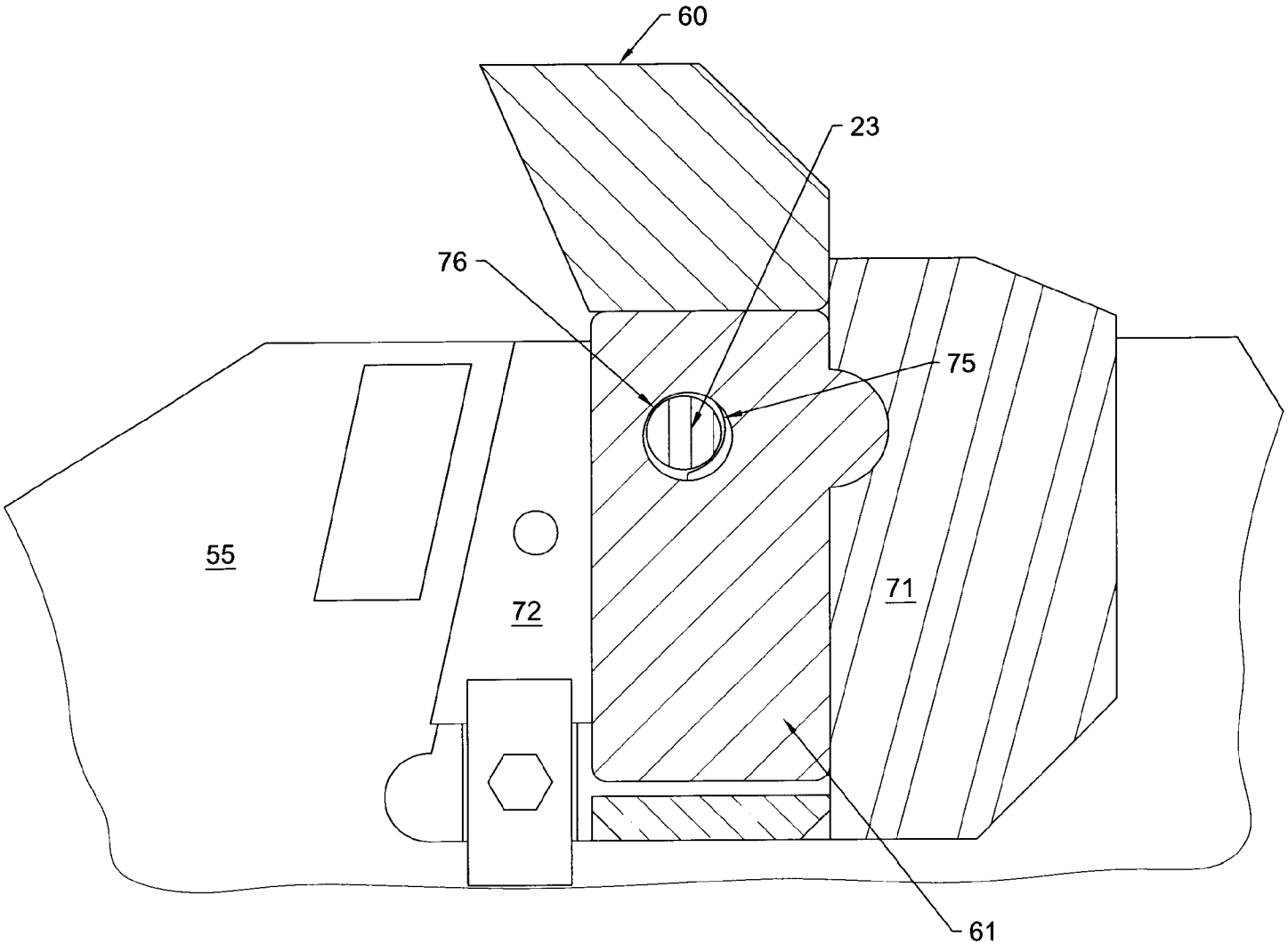

FIG. 20*d* is a cross-sectional view at a location indicated by dashed line DD having neither a ridge of the hammer or adaptor, or a cavity of the hammer or adaptor.

It can be seen in FIGS. 16 and 20*d* that retainer groove 74 of the adaptor transitions to a cylindrical bore 76 at various portions of the adaptor that are away from the cavities 65. The retainer grooves 74 and cylindrical bore 76 preferably have the same radius.

As discussed above, retainer rod 23 is inserted into the cavity formed by retainer rod grooves 74 and 75, as best shown in FIG. 20*c* and into the cylindrical bore 76, to prevent demounting of the hammer from the adaptor. It is necessary to insert the retainer rod in a direction from one end of the rotor to the opposite end of the rotor, as shown in FIG. 15. However it is not necessary to remove the hammers by sliding them out in the same direction as for the retainer rod, as after the retainer rod is removed, the hammer can be removed by pulling it outwardly in a direction indicated by arrow (B) in FIG. 15. As mentioned above, a rotary crushing machine most often has side plates near ends of the rotor and access to end portions of the rotor are difficult.

In the present invention, only a small access hole in one of the side plates of the machine is required for use in mounting the hammers and removing the hammers when replacement is necessary or alternatively the adaptor can be removed from the rotor prior to replacing the hammers. To mount the hammers 60 to the adaptor 61 the grooved portions 70 and ridge portions 69 of the hammers are placed over the ridges 64 and grooves 65 of the adaptor, as shown in FIG. 18. Next, the retainer rod 23 is inserted to pass through the cavity formed by the retainer rod grooves 74 in the adaptor and retainer rod grooves 75 in the hammers, and the cylindrical bores 76.

In order to keep the retainer rod 23 in place, a keeper plate 77 as shown in FIG. 20*a* is bolted into place. It is important that the keeper plate and the head of a bolt 78 be below the plane of the end of the rotor, so as not to make contact with the side plates of the machine which are disposed near ends of the rotor. As shown in FIGS. 15 and 19, a keeper plate recess 79 is formed at an end of the adaptor to accommodate the keeper plate and bolt head.

To replace a hammer it is necessary to retract the retainer rod in a direction opposite to that described above for inserting the rod. To facilitate the retracting a threaded coupling 29, as shown in FIG. 5, is attached to the retainer rod prior to inserting the retainer rod when mounting the hammer to the adaptor. The threaded coupling can also be an integral part of the retainer rod. Preferably the threaded coupling has internal threads (female) into which an extraction tool (not shown), having external threads (male) of the same size and pitch can be threaded. After threading the extraction tool into the threaded coupling, force can be applied outwardly to remove the retainer rod from the hammer assembly.

With the attachment as described, the retainer rod can be rotated while applying the force to facilitate the extraction. By having internal threads and using a thread cap for the threads on the threaded coupling, there is less chance that the threads will become damaged during operation of the machine. An additional recess, as shown at 80 in FIG. 19, can be formed in the end of the adaptor to accommodate the threaded coupling.

In a preferred embodiment, the adaptor has recesses 79 and 80 in both ends to enable insertion of the retainer rod in either direction, as different rotary material crusher machines can be accessed easier on one side or the other.

The invention claimed is:

1. A hammer assembly for attachment to a rotor of a rotary material crusher, said rotor having a periphery portion and opposing ends, and being driven to rotate about an axis of rotation extending through the ends, said hammer assembly comprising:

an adaptor for attaching to the rotor, the adaptor having a base portion and a hammer mounting portion, with the base portion being attachable to said rotor at the periphery portion thereof so as to align a longitudinal axis of the adaptor parallel to the axis of rotation of the rotor, said adaptor having a retainer rod groove and a cylindrical bore, said cylindrical bore transitioning into said retainer rod groove and having a common central axis extending through the hammer mounting portion thereof in a direction parallel to the longitudinal axis of the adaptor, and a hammer for mounting on the adaptor, the hammer having at least one impact portion for crushing material, and a mounting portion for engagement with the hammer mounting portion of the adaptor so as to align a longitudinal axis of the hammer parallel to the axis of rotation of the rotor, said hammer having a retainer rod groove extending through the mounting portion thereof in a direction parallel to the longitudinal axis of the hammer, wherein said adaptor and said hammer each include at least one cavity portion and at least one ridge portion, with the at least one cavity portion of the adaptor and the hammer mating, when mounted, with the at least one ridge portion of the hammer and adaptor, respectively, wherein the hammer mounting portion of the adaptor includes bearing surfaces facing a direction of impact when crushing material, and the mounting portion of the hammer includes bearing surfaces for mating with the bearing surfaces of the hammer mounting portion of the adaptor, the hammer assembly further comprising:

a retainer rod for preventing demounting of the hammer from the adaptor, said retainer rod being free to move in relation to said hammer and adaptor, wherein when the hammer is mounted on the adaptor, the retainer rod groove of the hammer faces the retainer rod groove of the adaptor, the retainer rod passes alternatingly through the cylindrical bore and a cavity formed by the retainer rod groove of the hammer and the retainer rod groove of the adaptor, with each of the grooves only partially encircling the retainer rod, the hammer being free to move to enable the bearing surfaces of the hammer to bear on the bearing surfaces of the adaptor to transfer impact forces from the hammer to the adaptor when impact forces from crushing material are present, and when the bearing surfaces of the hammer are bearing on the bearing surfaces of the adaptor the bearing surfaces prevent movement of the grooves relative to each other so as to maintain a clearance between the retainer rod and at least one of the retainer rod grooves.

2. The hammer assembly of claim 1, wherein said hammer assembly further includes a threaded coupling with internal threads, the threaded coupling being attached by the threads to the retaining rod.

* * * * *